US012351970B2

(12) United States Patent
Murphy et al.

(10) Patent No.: US 12,351,970 B2
(45) Date of Patent: Jul. 8, 2025

(54) DISPENSING ASSEMBLY FOR APPLIANCE

(71) Applicant: WHIRLPOOL CORPORATION, Benton Harbor, MI (US)

(72) Inventors: Sayer James Murphy, St. Joseph, MI (US); Christopher Aidan Hartnett, St. Joseph, MI (US); Tristan James VanFossen, Benton Harbor, MI (US); Scott E. Carpenter, Sawyer, MI (US); Joel Matthew Sells, Watervliet, MI (US); Brent Michael Burgess, Edwardsburg, MI (US); Richard Lee Hammond, Mattawan, MI (US); Gregory Edward Bauman, Stevensville, MI (US); Demetrius Schaaf, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 926 days.

(21) Appl. No.: 17/163,919

(22) Filed: Feb. 1, 2021

(65) Prior Publication Data

US 2022/0243383 A1 Aug. 4, 2022

(51) Int. Cl.
*D06F 39/02* (2006.01)

(52) U.S. Cl.
CPC ..... *D06F 39/02* (2013.01)

(58) Field of Classification Search
CPC ..... B05B 11/0078; B05B 11/1081; B05C 17/00553; B65D 83/68
USPC ..... 222/327, 326, 325
See application file for complete search history.

(56) References Cited

U.S. PATENT DOCUMENTS

| | | | | |
|---|---|---|---|---|
| 3,267,703 | A | 8/1966 | Conrath et al. | |
| 5,176,297 | A | 1/1993 | Mooney et al. | |
| 5,675,994 | A | 10/1997 | Gweon | |
| 7,097,079 | B2 | 8/2006 | Miefalk et al. | |
| 7,472,710 | B2 * | 1/2009 | Jowett | A47L 15/4472 68/17 R |
| 7,895,770 | B2 | 3/2011 | Bae et al. | |
| 8,171,757 | B2 | 5/2012 | Dahlke | |
| 8,461,959 | B2 | 6/2013 | Ebrom et al. | |
| 8,555,677 | B2 | 10/2013 | Hendrickson et al. | |
| 8,839,648 | B2 | 9/2014 | Je et al. | |
| 8,931,667 | B2 | 1/2015 | Smith et al. | |
| 8,943,858 | B2 | 2/2015 | Burgess | |

(Continued)

FOREIGN PATENT DOCUMENTS

| | | | |
|---|---|---|---|
| CN | 107287834 | A | 10/2017 |
| CN | 208266483 | U | 12/2018 |

(Continued)

*Primary Examiner* — Ishal Pancholi
*Assistant Examiner* — Robert K Nichols, II
(74) *Attorney, Agent, or Firm* — Price Heneveld LLP

(57) ABSTRACT

A dispensing assembly for a laundry appliance includes a cabinet defining a cartridge port. A dispensing device is coupled to the cabinet and extends into the cartridge port. A dispensing cartridge is selectively received by the cartridge port. The dispensing cartridge selectively engages the dispensing device when in an installed position within the cartridge port. The dispensing cartridge includes a nesting portion configured to house a first laundry chemistry. An insert portion is configured to house a second laundry chemistry. The nesting portion selectively receives the insert portion.

18 Claims, 15 Drawing Sheets

(56) References Cited

U.S. PATENT DOCUMENTS

| | | | | |
|---|---|---|---|---|
| 9,057,150 | B2 | 6/2015 | Zattin et al. | |
| 9,435,066 | B2 | 9/2016 | Lee et al. | |
| 9,506,183 | B2 | 11/2016 | Del Pos et al. | |
| 9,644,307 | B2 | 5/2017 | Da Pont et al. | |
| 9,970,149 | B2 | 5/2018 | Bao et al. | |
| 10,125,448 | B2 | 11/2018 | Seo et al. | |
| 10,202,565 | B2 | 2/2019 | Roselle | |
| 10,333,731 | B2 | 6/2019 | Ebrom et al. | |
| 10,595,705 | B2 | 3/2020 | Wegener et al. | |
| 10,648,119 | B2 | 5/2020 | Jung et al. | |
| 2002/0088502 | A1 | 7/2002 | Van Rompuy et al. | |
| 2006/0272359 | A1 | 12/2006 | Kang | |
| 2008/0072632 | A1 | 3/2008 | Je et al. | |
| 2008/0078211 | A1 | 4/2008 | Je et al. | |
| 2008/0276969 | A1 | 11/2008 | Vanantwerp et al. | |
| 2010/0071729 | A1* | 3/2010 | Classen | A47L 15/4472 134/93 |
| 2010/0125364 | A1* | 5/2010 | Ebrom | D06F 39/02 700/275 |
| 2010/0161143 | A1 | 6/2010 | Smith et al. | |
| 2010/0192993 | A1 | 8/2010 | Housmekerides et al. | |
| 2011/0180118 | A1 | 7/2011 | Schrott | |
| 2013/0312463 | A1 | 11/2013 | Kim et al. | |
| 2015/0240407 | A1 | 8/2015 | Hendrickson | |
| 2016/0258106 | A1 | 9/2016 | Kim | |
| 2016/0289883 | A1 | 10/2016 | Lv et al. | |
| 2019/0109723 | A1 | 4/2019 | Ebrom et al. | |
| 2020/0040510 | A1 | 2/2020 | Lv et al. | |
| 2020/0102124 | A1 | 4/2020 | Driskell et al. | |
| 2020/0325620 | A1 | 10/2020 | Chae et al. | |
| 2020/0397219 | A1* | 12/2020 | Fawaz | A47L 15/4409 |
| 2022/0095885 | A1* | 3/2022 | Boyer | A47L 15/4472 |

FOREIGN PATENT DOCUMENTS

| | | | |
|---|---|---|---|
| CN | 110387692 | A | 10/2019 |
| DE | 102018126625 | A1 | 4/2020 |
| DK | 2733249 | T3 | 2/2017 |
| EP | 0297371 | B1 | 6/1992 |
| EP | 0691099 | A2 | 1/1996 |
| EP | 2398373 | B1 | 2/2010 |
| EP | 2589698 | A1 | 5/2013 |
| EP | 2003237 | B1 | 5/2016 |
| EP | 2566943 | B1 | 9/2017 |
| EP | 3617379 | A1 | 3/2020 |
| EP | 3176305 | B1 | 9/2020 |
| FR | 2966168 | A1 | 10/2012 |
| JP | 6650241 | | 4/2017 |
| WO | 200898729 | A1 | 8/2008 |
| WO | 2013156750 | A1 | 10/2013 |
| WO | 2015028247 | A1 | 3/2015 |
| WO | 2017186495 | A1 | 11/2017 |
| WO | 2018123493 | A1 | 7/2018 |
| WO | 2018233576 | A1 | 12/2018 |
| WO | 2019037993 | A1 | 2/2019 |
| WO | 202047681 | A1 | 3/2020 |
| WO | 2020115184 | A2 | 6/2020 |
| WO | 2020152004 | A1 | 7/2020 |
| WO | 2020152005 | A1 | 7/2020 |

* cited by examiner

DISPENSING ASSEMBLY FOR APPLIANCE

BACKGROUND OF THE DISCLOSURE

The present disclosure generally relates to a dispensing assembly for an appliance, and more specifically, to a dispensing assembly for a laundry appliance that utilizes a removable cartridge.

SUMMARY OF THE DISCLOSURE

According to one aspect of the present disclosure, a dispensing assembly for a laundry appliance includes a cabinet defining a cartridge port. A dispensing device is coupled to the cabinet and extends into the cartridge port. A dispensing cartridge is selectively received by the cartridge port. The dispensing cartridge selectively engages the dispensing device when in an installed position within the cartridge port. The dispensing cartridge includes a nesting portion configured to house a first laundry chemistry. An insert portion is configured to house a second laundry chemistry. The nesting portion selectively receives the insert portion.

According to another aspect of the present disclosure, a dispensing assembly for a laundry appliance includes a cabinet defining a cartridge port. A dispensing cartridge is selectively received in the cartridge port. A dispensing actuator is coupled to the cabinet and configured to selectively engage the dispensing cartridge when the dispensing cartridge is in an installed position in the cartridge port. A cover is operably coupled to the cabinet. The cover is operable between a closed position and an opened position to selectively allow access to the dispensing cartridge. The cover biases the dispensing cartridge into the installed position when the cover is in the closed position.

According to yet another aspect of the present disclosure, a dispensing system for a laundry appliance includes a first dispensing cartridge having a first chemistry reservoir and a second dispensing cartridge has a second chemistry reservoir. The second dispensing cartridge is disposed proximate to the first dispensing cartridge. A dispensing device is in selective communication with the first chemistry reservoir and the second chemistry reservoir. An engagement assembly is operably coupled to at least one of the dispensing device, the first dispensing cartridge, and the second dispensing cartridge. The engagement assembly is operable between a first position and a second position. A controller is in communication with the engagement assembly. The controller adjusts the engagement assembly between the first position and the second position to selectively engage the dispensing device with a selected one of the first dispensing cartridge and the second dispensing cartridge.

These and other features, advantages, and objects of the present disclosure will be further understood and appreciated by those skilled in the art by reference to the following specification, claims, and appended drawings.

Figure 1:
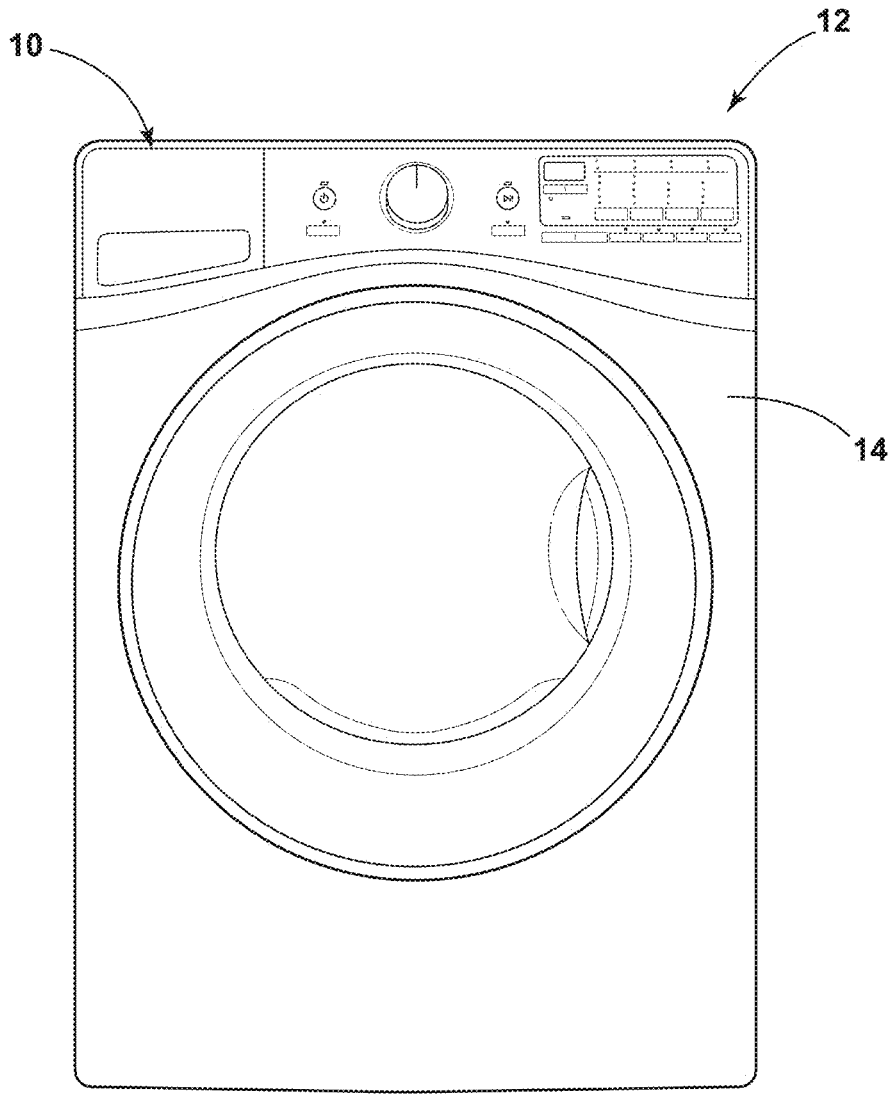
FIG. 1 is a front elevational view of a horizontal axis laundry appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a dispensing assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-22, reference numeral 10 generally designates to a dispensing assembly for a laundry appliance 12. A cabinet 14 of the laundry appliance 12 defines a cartridge port 16. A dispensing device 18 is coupled to the cabinet 14 and extends into the cartridge port 16. A dispensing cartridge 20 is selectively received by the cartridge port 16. The dispensing cartridge 20 selectively engages the dispensing device 18 when in an installed position 22 within the cartridge port 16. The dispensing cartridge 20 includes a nesting portion 24 configured to house a first laundry chemistry and an insert portion 26 configured to house a second laundry chemistry. The nesting portion 24 selectively receives the insert portion 26.

Figure 2:
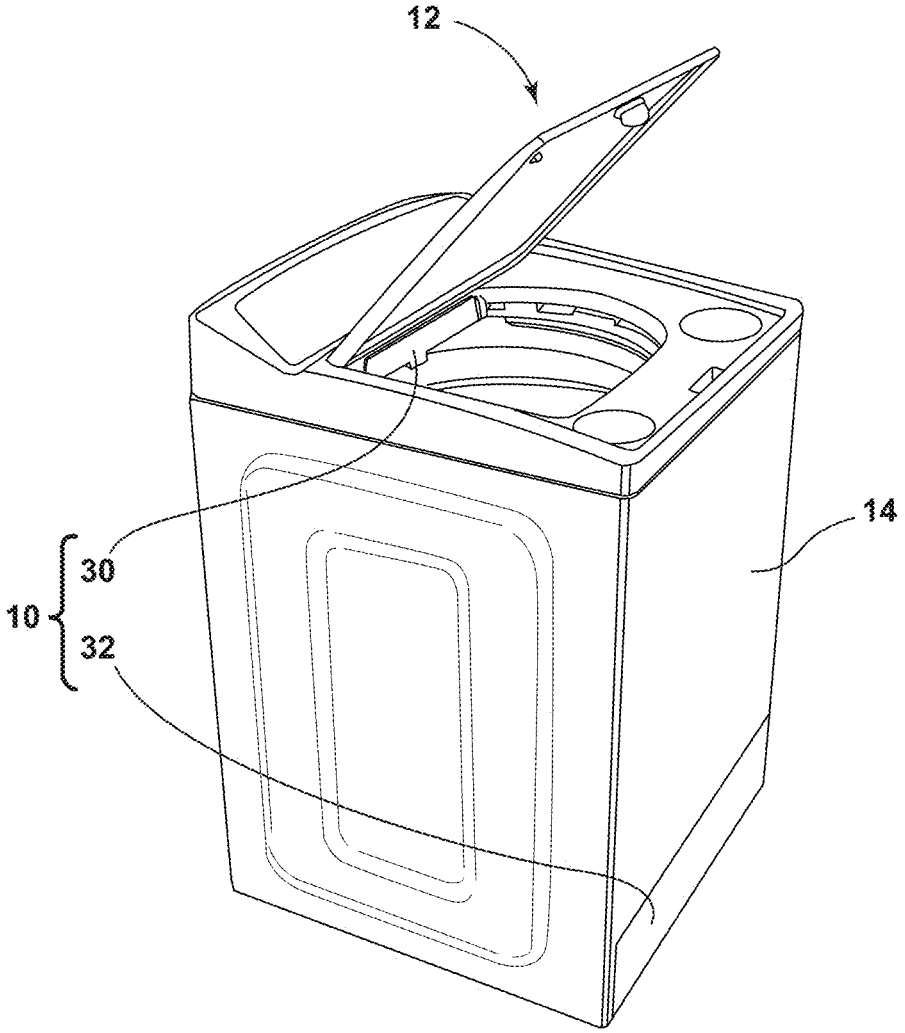
FIG. 2 is a side perspective view of a vertical axis laundry appliance with a lid in an opened position, according to the present disclosure.

Referring to FIGS. 1 and 2, the dispensing assembly 10 is utilized within the laundry appliance 12 to dispense laundry chemistry to a treatment chamber. As illustrated in FIG. 1, the laundry appliance 12 may be a horizontal axis laundry appliance 12. In such configurations, the dispensing assembly 10 is typically positioned in an upper portion, such as an upper corner, of the cabinet 14. As illustrated in FIG. 2, the laundry appliance 12 may be a vertical axis laundry appliance 12. In such configurations, the laundry appliance 12 includes at least one of a first drawer 30 positioned proximate to an opening into the treatment chamber of the laundry appliance 12 and a second drawer 32 positioned in a lower portion of the cabinet 14 below the treatment chamber. The dispensing assembly 10 may be positioned in either one or both of the first drawer 30 and the second drawer 32.

The cabinet 14 defines the cartridge port 16 to receive the dispensing cartridge 20. At least one of the dispensing cartridge 20 and the cartridge port 16 includes alignment features for aligning the dispensing cartridge 20 within the cartridge port 16 to engage the dispensing device 18. The dispensing cartridge 20 is in fluid communication with a dispensing channel. The dispensing device 18 is configured to dispense the laundry chemistry housed within the dispensing cartridge 20 to the dispensing channel, which delivers the laundry chemistry to the treatment chamber. The dispensing device 18 serves to dose a specific amount of laundry chemistry from the dispensing cartridge 20. The laundry chemistry may include, but is not limited to, detergent, fabric softener, bleach, oxi-type chemistries, and other similar laundry-related chemistries. The treatment chamber may be in the form of a drum and/or tub and can further be in the form of a horizontal axis chamber, a vertical axis chamber, or other angled chamber that rotates about a rotational axis within the cabinet 14.

Referring still to FIGS. 1 and 2, as well as to FIGS. 3A-3F, the dispensing cartridge 20 may have a variety of configurations, which includes dispensing cartridges 20A-20F, collectively referred to herein as the dispensing cartridges 20. Depending on the configuration of the dispensing cartridge 20, at least a volume of laundry chemistry, a number of laundry chemistries, and the type of laundry chemistries can be adjusted. Generally, the dispensing cartridge 20 is utilized for bulk dispensing. In this way, a single dose of laundry chemistry can be dispensed for a single laundry cycle, while storing additional laundry chemistry. The size, volume, and concentration of the laundry chemistry determine the number of laundry cycles available in each dispensing cartridge 20. The dispensing cartridge 20 is configured to house a predetermined amount of laundry chemistry within a chemistry reservoir 38. The predetermined amount of laundry chemistry is typically used for a predefined number of laundry cycles (e.g., a predefined number of single doses). Each cycle can use a single dose of laundry chemistry or multiple single-dose amounts of the laundry chemistry.

Generally, an engagement panel 40 is coupled to an end of the dispensing cartridge 20. The engagement panel 40 includes a handle 42 that extends along a top edge of the engagement panel 40 and creates a grasping location for a user to draw or pull the dispensing cartridge 20 relative to the cartridge port 16. The engagement panel 40 extends a greater height than a portion of the dispensing cartridge 20 that defines the chemistry reservoir 38, which may obscure connectors extending between the dispensing cartridge 20 and the laundry appliance 12.

Figure 3A:
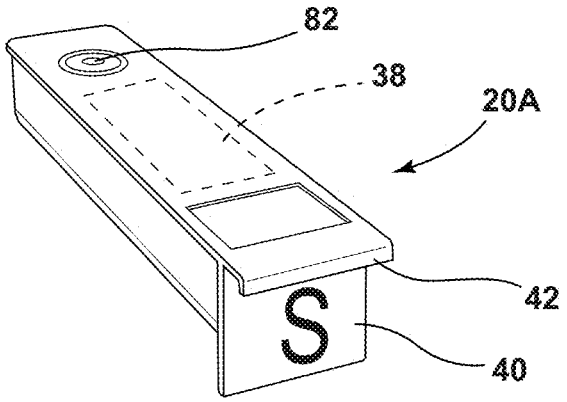
FIG. 3A is a top perspective view of a single-sized, single chemistry dispensing cartridge, according to the present disclosure.
Figure 3B:
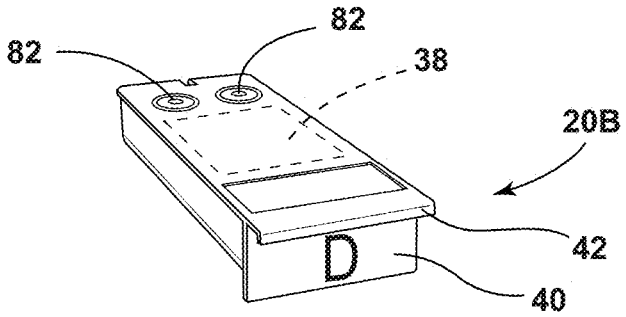
FIG. 3B is a top perspective view of a double-sized, single chemistry dispensing cartridge, according to the present disclosure.

As illustrated in FIG. 3A, the dispensing cartridge 20 is configured as a single-sized dispensing cartridge 20A, which houses the predefined amount of laundry chemistry within the single chemistry reservoir 38. In comparison, as illustrated in FIG. 3B, the dispensing cartridge 20B is configured as a double-sized, single chemistry cartridge. The dispensing cartridge 20B includes a single chemistry reservoir 38 that is configured to hold approximately double the volume of laundry chemistry relative to the single-sized dispensing cartridge 20A.

Figure 3C:
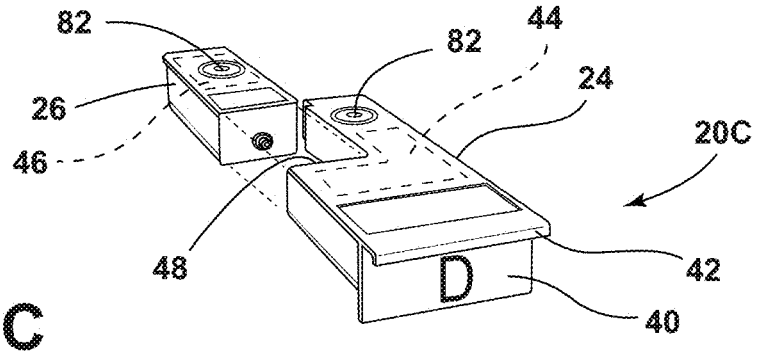
FIG. 3C is a top perspective view of a double-sized, dual chemistry dispensing cartridge, according to the present disclosure.

The double-sized, dual chemistry laundry dispensing cartridge 20C is illustrated in FIG. 3C. In an overall volume of laundry chemistry, the dual chemistry dispensing cartridge 20C is generally configured to hold about the same volume of laundry chemistry as the single chemistry dispensing cartridge 20B. However, the dispensing cartridge 20C includes the nesting portion 24 and the insert portion 26 for separately housing two different types of laundry chemistry. Accordingly, different laundry chemistries can be dispensed simultaneously or contemporaneously to create combinations of chemistry mixtures. The nesting portion 24 includes a first chemistry reservoir 44 and the insert portion 26 includes a second chemistry reservoir 46. Typically, the first chemistry reservoir 44 can hold a greater volume of laundry chemistry than the second chemistry reservoir 46. The different volumes of the chemistry reservoirs 44, 46 may be advantageous for dispensing two types of laundry chemistries in different quantities. For example, a laundry cycle may utilize more detergent than fabric softener. In this example, the detergent is housed in the nesting portion 24, allowing for greater storage of the detergent, and the fabric softener is housed within the insert portion 26.

The insert portion 26 is an interchangeable section of the overall dispensing cartridge 20C. The interchangeable nature of the insert portion 26 allows the user to change a secondary laundry chemistry used for certain laundry cycles. The nesting portion 24 may be utilized independently of and in combination with the insert portion 26. However, the insert portion 26 may not typically be used independently of the nesting portion 24.

The insert portion 26 is selectively received by a supplemental receiver 48 defined by the nesting portion 24. The insert portion 26 is configured to be seated or nested in a receiving area defined by the nesting portion 24. The supplemental receiver 48 can have a variety of configurations for selectively receiving the insert portion 26. For example, the nesting portion 24 and the insert portion 26 may each include mating latches for coupling the insert portion 26 to the nesting portion 24. Additionally or alternatively, the nesting portion 24 may have an outer wall that defines a space for receiving the insert portion 26, where the outer wall extends around a perimeter of the insert portion 26. In additional examples, one or both of the nesting portion 24 and the insert portion 26 can include interlocking features, snap features, sliding members, or other mating or engageable features.

As illustrated in FIG. 3C, a first side of the nesting portion 24 may have a shorter length to allow the insert portion 26 to be coupled and nested into the nesting portion 24. As such, the insert portion 26 is spaced from the engagement panel 40.

Figure 3D:
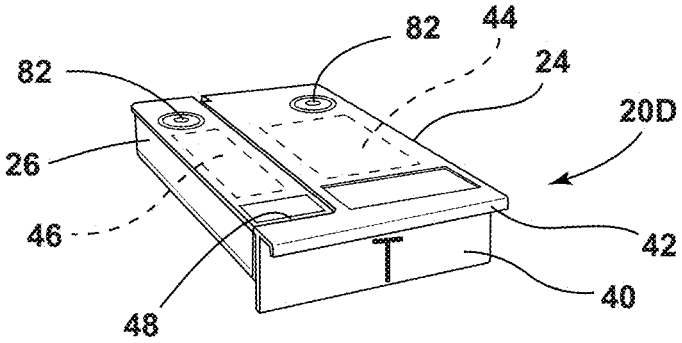
FIG. 3D is a top perspective view of a triple-sized, dual chemistry dispensing cartridge, according to the present disclosure.

Referring to FIG. 3D, a triple-sized, dual chemistry dispensing cartridge 20D is illustrated. The overall volume of laundry chemistry stored within the triple-sized dispensing cartridge 20D is approximately triple the volume as the single-sized dispensing cartridge 20A. Similar to the double-sized, dual chemistry dispensing cartridge 20C, the triple-sized, dual chemistry dispensing cartridge 20D includes the nesting portion 24 having the first chemistry reservoir 44 and the insert portion 26 having the second chemistry reservoir 46. The first chemistry reservoir 44 holds a greater volume of laundry chemistry than the second chemistry reservoir 46. In this configuration, the engagement panel 40 of the nesting portion 24 includes the supplemental receiver 48.

The engagement panel 40 has a greater width than a width of the portion that defines the first chemistry reservoir 44. The increased width of the engagement panel 40 provides the receiving space and the supplemental receiver 48 for receiving the insert portion 26. The insert portion 26 is selectively coupled to the engagement panel 40 and has a substantially similar length as the nesting portion 24. Accordingly, the insert portion 26 is nested into a receiving space defined between the portion of the nesting portion 24 having the first chemistry reservoir 44 and the engagement panel 40. It is contemplated that the insert portion 26 may be spaced apart from the engagement panel 40, similar to the configuration illustrated in FIG. 3C. It is also contemplated that the dispensing cartridge 20 may be a triple-sized, single chemistry dispensing cartridge 20 without departing from the teachings herein.

Figure 3E:
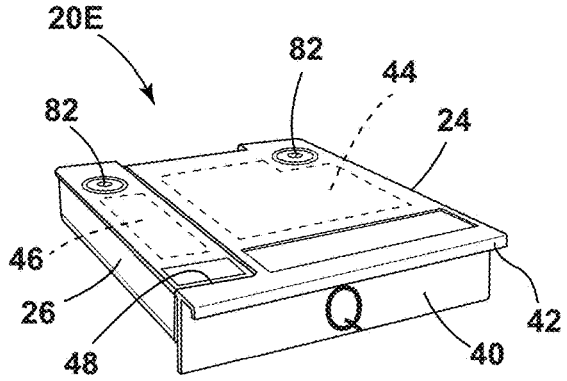
FIG. 3E is a top perspective view of a quad-sized, dual chemistry dispensing cartridge, according to the present disclosure.

Referring to FIG. 3E, a quad-sized, dual chemistry dispensing cartridge 20E is illustrated. The quad dispensing cartridge 20E generally includes four times the overall volume of laundry chemistry relative to the single-sized dispensing cartridge 20A. Similar to the triple-sized, dual chemistry dispensing cartridge 20D, the insert portion 26 is coupled to the engagement panel 40. It is contemplated that a smaller insert portion 26 may be utilized similar to the configuration in FIG. 3C. Further, it is contemplated that the quad dispensing cartridge 20E may have the single chemistry reservoir 38.

Figure 3F:
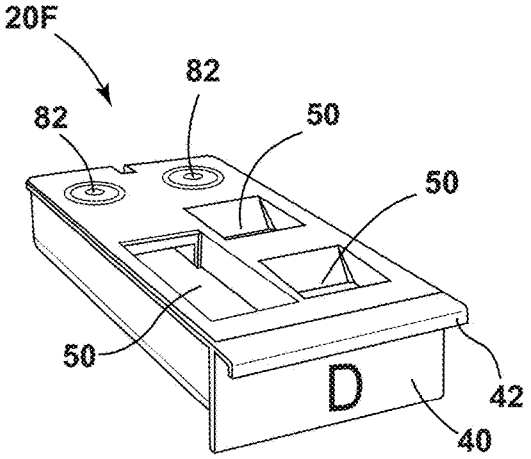
FIG. 3F is a top perspective view of a double-sized, single-dose dispensing cartridge, according to the present disclosure.

Referring to FIG. 3F, an additional or alternative configuration of the dispensing cartridge 20 is illustrated as the double-sized, single-dose dispensing cartridge 20F. The dispensing cartridge 20F includes single-dose chemistry reservoirs 50. Each of these chemistry reservoirs 50 is configured to receive a single dose of laundry chemistry. The single-dose may be in liquid form, powder form, a tablet, or a pouch and positioned within the chemistry reservoirs 50 prior to a laundry cycle. The dispensing cartridge 20F may be utilized for laundry chemistries that are used less frequently by the user, such that a bulk dispensing cartridge 20 may be less advantageous.

Referring still to FIGS. 3A-3F, as well as to FIGS. 4A-4D, the cabinet 14 of the laundry appliance 12 defines the cartridge port 16 for receiving at least one dispensing cartridge 20. The size and shape of the cartridge port 16 correspond with the size and shape of the dispensing cartridge 20. The size and shape of the cartridge port 16 may also depend on the size and configuration of the laundry appliance 12.

Figure 4A:
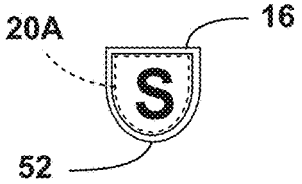
FIG. 4A is a schematic front elevational view of a cartridge port having a single receiving space, according to the present disclosure.
Figure 4B:
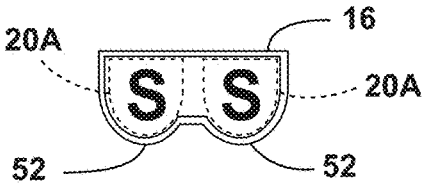
FIG. 4B is a schematic front elevational view of a cartridge port having two receiving spaces, according to the present disclosure.

For example, as illustrated in FIG. 4A, the cartridge port 16 is configured to receive the single-sized dispensing cartridge 20A. The bottom of the cartridge port 16 defines a groove 52 to slidably receive a rounded bottom of the dispensing cartridge 20A. As illustrated in FIG. 4B, the cartridge port 16 has two grooves 52 and is configured to receive one double-sized dispensing cartridge 20B, 20C, 20F or two single-sized dispensing cartridges 20A. The cartridge port 16 is a single opening with both grooves 52 configured to receive the bottom of one or more dispensing cartridges 20. For example, each groove 52 can receive a single-sized dispensing cartridge 20A. Two single-sized dispensing cartridges 20A are arranged parallel to one another, with each dispensing cartridge 20A disposed within one groove 52. Alternatively, some of the dispensing cartridge 20 may utilize both grooves 52. For example, the double-sized dispensing cartridge 20B, 20C, 20F includes two rounded portions that slidably engage the two grooves 52 (see FIG. 4C). The dispensing cartridge 20 is shaped to mate with the shape of the cartridge port 16.

Figure 4C:
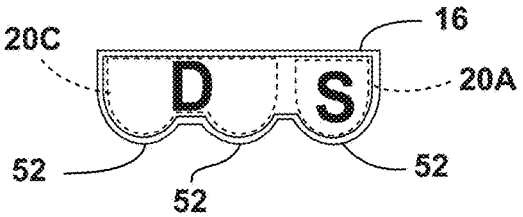
FIG. 4C is a schematic front elevational view of a cartridge port having three receiving spaces divided into two portions, according to the present disclosure.

As illustrated in FIG. 4C, the cartridge port 16 includes three grooves 52. The cartridge port 16 may receive one triple-sized dispensing cartridge 20D or a combination of double-sized dispensing cartridges 20B, 20C, 20F and single-sized dispensing cartridges 20A. The cartridge port 16 may be a single opening, which provides increased flexibility for combinations of dispensing cartridges 20. It is also contemplated that the cartridge port 16 may include partitions disposed between some or all of the adjacent grooves 52 to define separate receiving spaces. The separate receiving spaces may limit what dispensing cartridges 20 can be used within certain portions of the cartridge port 16.

Figure 4D:
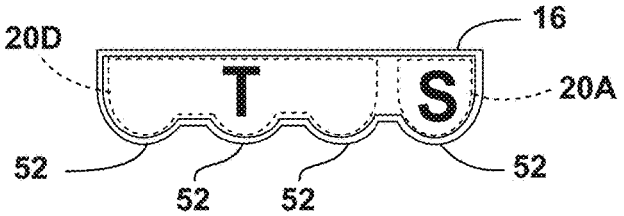
FIG. 4D is a schematic front elevational view of a cartridge port having four receiving spaces divided into two portions, according to the present disclosure.

Referring to FIG. 4D, a cartridge port 16 having four grooves 52 is illustrated. The four receiving spaces are linearly arranged and can receive a single quad-sized dispensing cartridge 20E or a combination of single, double, and triple-sized dispensing cartridges 20A-20D, 20E. The cartridge port 16 may be a single opening, which provides increased flexibility for combinations of dispensing cartridges 20 within the four grooves 52. It is contemplated that the cartridge port 16 may include one or more partitions to limit which dispensing cartridges 20 can be received in certain receiving spaces of the cartridge port 16.

Referring still to FIGS. 3A-4D, the configuration of the cartridge port 16 allows for a number of combinations of dispensing cartridges 20 to be positioned within the laundry appliance 12. While the receiving spaces are illustrated as grooves 52 in a horizontal arrangement, other configurations may be utilized depending on the configuration of the laundry appliance 12. The receiving spaces may be arranged horizontally, vertically, a combination of horizontally and vertically, linearly, in different portions of the cabinet, or other practicable arrangements. The cartridge ports 16 described herein may be defined in the upper portion of the cabinet 14, as illustrated in FIG. 1, in the first drawer 30, and/or the second drawer 32, as illustrated in FIG. 2. The laundry appliance 12 may include covers for concealing all of the cartridge ports 16 and/or cartridge ports 16 not currently housing the dispensing cartridge 20.

Figure 5:
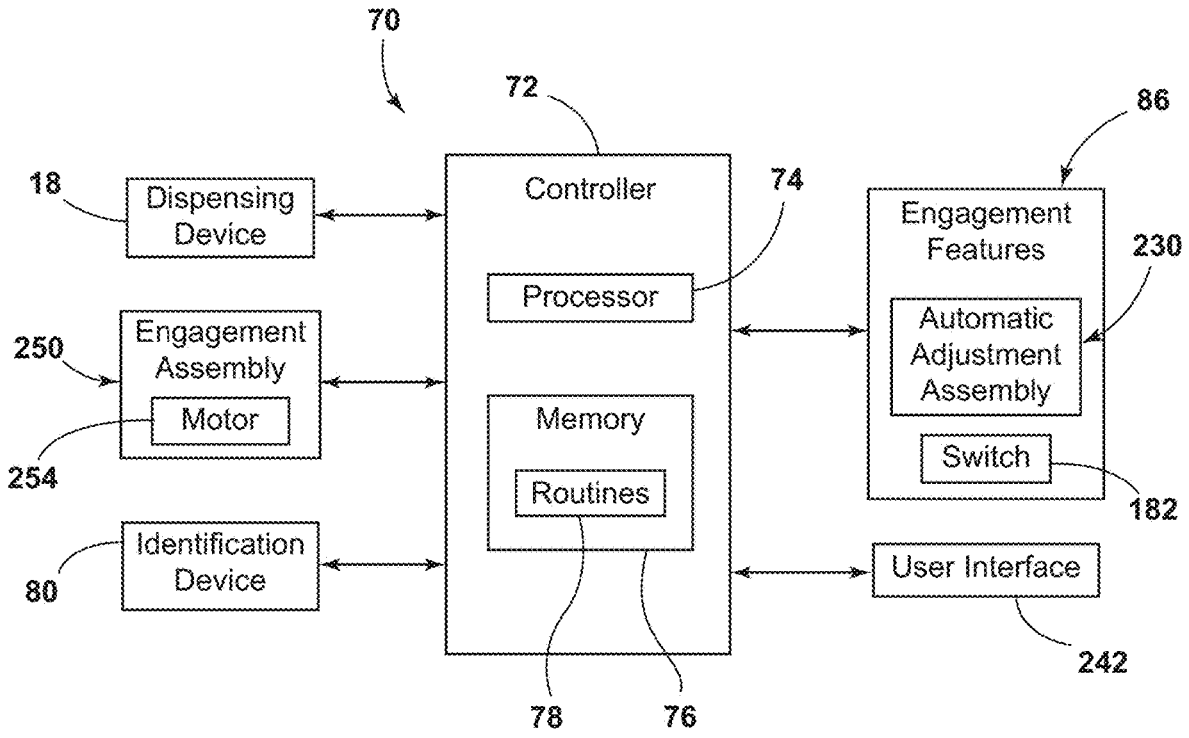
FIG. 5 is a block diagram of a dispensing system for a laundry appliance, according to the present disclosure.

Referring to FIG. 5, the laundry appliance 12 includes a dispensing system 70 to automatically dispense the laundry chemistry from the dispensing cartridge 20. The dispensing system 70 includes various electrical and/or data connections that couple with a controller 72. The controller 72 has a processor 74, a memory 76, and other control circuitry. Instructions or routines 78 are stored in the memory 76 and executable by the processor 74. The controller 72 may be an appliance control unit of the laundry appliance 12 or may be a designated control unit for the dispensing system 70. During operation of the laundry appliance 12, various signals and commands are delivered to the dispensing system 70, typically via the controller 72, for operating the dispensing device 18 and other aspects of the dispensing system 70.

The dispensing system 70 generally includes an identification device 80 disposed proximate to the cartridge port 16. The identification device 80 is configured to read or otherwise determine information about the dispensing cartridge 20 from an identification feature 82 coupled to the dispensing cartridge 20. As the dispensing system 70 allows the interchangeability between the dispensing cartridges 20 and portions of the dispensing cartridge 20 (e.g., the insert portion 26), the identification feature 82 provides information to the controller 72 about the dispensing cartridge 20 and the laundry chemistry contained therein.

The identification feature 82 may include information relating to content within the dispensing cartridge 20, the size of the dispensing cartridge 20, a manufacturer or brand, a remaining amount of laundry chemistry, and an initial amount of laundry chemistry based on the size of the dispensing cartridge 20, recognition of whether a bulk dispensing cartridge 20 or a single-dose dispensing cartridge 20 is in the cartridge port 16, or combination thereof. The identification feature 82 may provide data relating to the authentication of the dispensing cartridge 20. Additionally or alternatively, the identification feature 82 may be utilized to maintain an approximate volume remaining in the dispensing cartridge 20. Further, data communicated from the identification device 80 and/or the identification feature 82 to the controller 72 may influence how the laundry chemistry in the dispensing cartridge 20 is dispensed. In additional or alternative examples, the identification feature 82 provides information to the controller 72 relating to current volume, concentration, density, and/or type of laundry chemistry within the dispensing cartridge 20. In this way, the identification feature 82 identifies a variety of information for the controller 72. The information communicated to the controller 72 is utilized by the laundry appliance 12 for dispensing the laundry chemistry.

In a specific example, the current fill volume of laundry chemistry within the dispensing cartridge 20 may be communicated to the controller 72. If a certain laundry cycle uses more than the current fill volume of laundry chemistry, the information communicated to the controller 72 may be communicated to a user that the current fill volume is insufficient for the requested laundry cycle. The user can then exchange the dispensing cartridge 20 and perform the selected laundry cycle. If the current fill volume information was not communicated to the controller 72, the selected laundry cycle may have been performed with less laundry chemistry. Accordingly, the current fill volume information may be communicated to the controller 72 to optimize performance of the laundry cycle and the laundry appliance 12. Additionally or alternatively, the information relating to the current fill level of laundry chemistry within the dispensing cartridge 20 allows the user to be notified when the dispensing cartridge 20 is at a low fill level or an empty fill level and should be exchanged with a new dispensing cartridge 20.

The identification device 80 and the corresponding identification feature 82 may include, for example, switches, a near field communication (NFC) reader and associated tags, a radio frequency identification (RFID) device and associated tags, or other similar electrical and data interfaces. Accordingly, the dispensing system 70 can identify information about the dispensing cartridge 20 inserted into the cartridge port 16, as well as the laundry chemistry within the dispensing cartridge 20. The information can be obtained when the dispensing system 70 detects a new dispensing cartridge 20 disposed within the cartridge port 16, prior to the start of any laundry cycle, or at any other practicable time. The identification feature 82 may identify information to the controller 82 about the dispensing cartridge 20, about the laundry chemistry in the dispensing cartridge 20, and other information for providing the laundry chemistry to the laundry appliance 12.

Referring to FIGS. 6A-20, the dispensing assembly 10 may include a variety of engagement features 86 that assist in inserting, removing, and/or retaining the dispensing cartridge 20 in the cartridge port 16. The engagement features 86 directed to inserting the dispensing cartridge 20 generally provide visual or tactile feedback to the user as confirmation that the dispensing cartridge 20 is fully seated within the cartridge port 16. The engagement features 86 directed to withdrawing or removing the dispensing cartridge assist in moving or adjusting the dispensing cartridge 20 partially out of the cartridge port 16 to be fully withdrawn by the user. The engagement features 86 directed to retaining the dispensing cartridge 20 within the cartridge port 16 generally operate to bias the dispensing cartridge 20 into the cartridge port 16 as the laundry chemistry is dispensed by the dispensing device 18. It is contemplated that the specific configurations of the engagement features 86 illustrated herein are merely exemplary and that aspects of the various engagement features 86 may be used in combination with one another.

When seated within the cartridge port 16, the dispensing device 18 engages the dispensing cartridge 20 to dispense laundry chemistry into the treatment chamber. The dispensing device 18 includes at least one of a pump 88 and a dispensing actuator 90 that engages the pump 88. The pump 88 may be disposed within the dispensing cartridge 20, within the cartridge port 16, or otherwise coupled with an insertion end 94 of the dispensing cartridge 20. The pump is in communication with the chemistry reservoir 38. For configurations of the dispensing cartridge 20 having the nesting portion 24 and the insert portion 26, two pumps 88 may be used, with a single pump 88 in fluid communication with each chemistry reservoir 44, 46 or a single movable pump 88 may be used, as disclosed further herein.

The dispensing actuator 90 is coupled to the cabinet 14 and extends into the cartridge port 16. The dispensing actuator 90 is in selective communication with the chemistry reservoir 38 of the dispensing cartridge 20. The dispensing actuator 90 is configured to engage the pump 88 to dispense the laundry chemistry from the dispensing cartridge 20 into the treatment chamber of the laundry appliance 12. When the pump 88 is disposed within the dispensing cartridge 20, the dispensing actuator 90 is configured to extend into the dispensing cartridge 20 to engage the pump 88. For configurations of the dispensing cartridge 20 having the nesting portion 24 and the insert portion 26, two dispensing actuators 90 may be used, with a single dispensing actuator 90 in fluid communication with each chemistry reservoir 44, 46 or a single movable dispensing actuator 90 may be used, as disclosed further herein.

Activation of the dispensing actuator 90 to dispense the laundry chemistry applies a force 92 to the insertion end 94 of the dispensing cartridge 20. Some or all of the engagement features 86 assist in overcoming this force 92 to retain the dispensing cartridge 20 within the cartridge port 16.

Figure 6A:
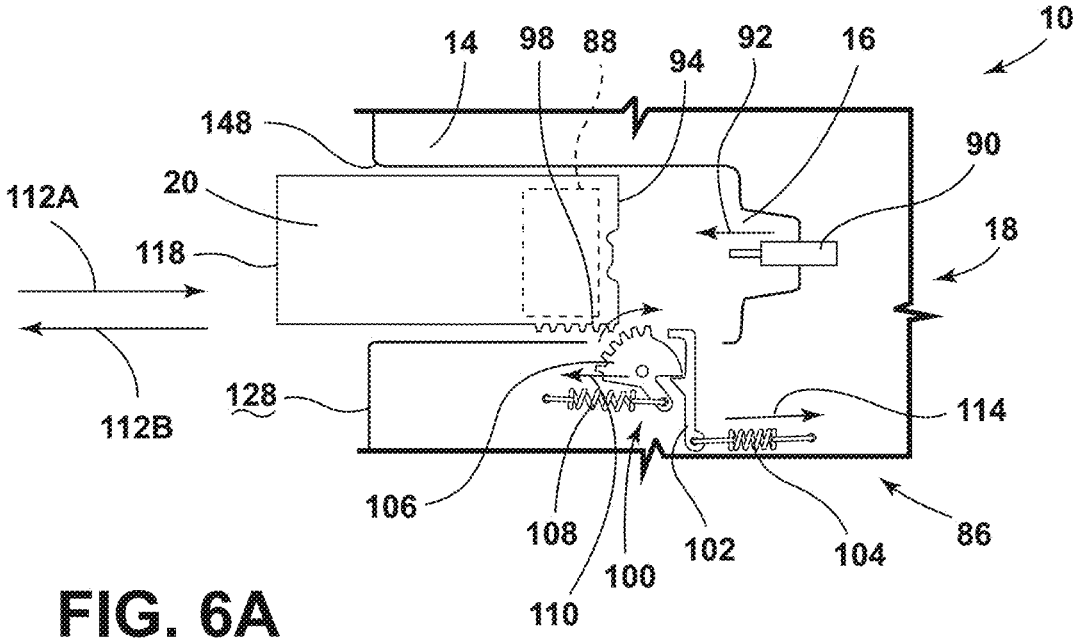
FIG. 6A is a schematic cross-sectional view of a dispensing cartridge and gears within a cartridge port for engaging a cartridge gear, according to the present disclosure.
Figure 6B:
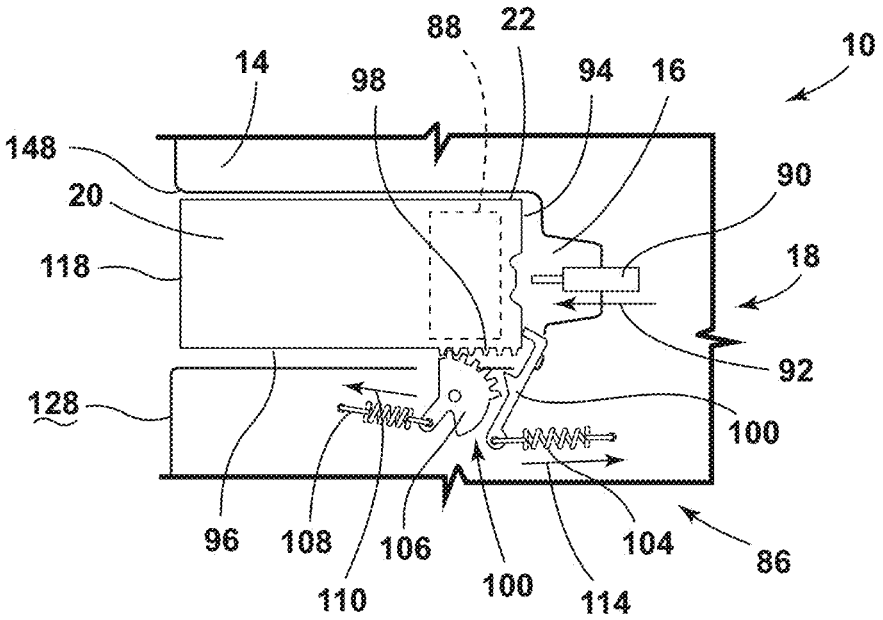
FIG. 6B is a schematic cross-sectional view of the dispensing cartridge of FIG. 6A disposed within the cartridge port.

As illustrated in FIGS. 6A and 6B, an outer wall 96 of the dispensing cartridge 20 defines a rack gear 98 adjacent to the insertion end 94. The rack gear 98 engages an insertion assembly 100 coupled with the cabinet 14 adjacent to the cartridge port 16. The insertion assembly 100 generally includes a latch 102 coupled to the cabinet 14 with a first biasing member 104 and a pinion gear 106 coupled to the cabinet 14 via a second biasing member 108. The pinion gear 106 and the latch 102 each extend into the cartridge port 16 to engage the dispensing cartridge 20.

Prior to the insertion of the dispensing cartridge 20 into the cartridge port 16, as illustrated in FIG. 6A, the latch 102 engages the pinion gear 106 and retains the pinion gear 106 in a loaded or cocked position. In this way, the latch 102 overcomes an outward biasing force 110 of the second biasing member 108. The user may adjust the dispensing cartridge 20 relative to the cartridge port 16 with a user-applied insertion force 112A and a user-applied removal force 112B. The user-applied insertion force 112A moves the dispensing cartridge 20 into the cartridge port 16 and into engagement with the insertion assembly 100. When the dispensing cartridge 20 engages the latch 102, the dispensing cartridge 20 pushes the latch 102 away from the pinion gear 106 to disengage the pinion gear 106 from the latch 102. The outward biasing force 110 of the first biasing member 104 rotates the pinion gear 106, which consequently pulls the dispensing cartridge 20 into the cartridge port 16 via the engagement with the rack gear 98. The second biasing member 108 is extended, against an inward biasing force 114 by the movement of the dispensing cartridge 20 relative to the latch 102.

The opposing biasing forces 110, 114 operate to adjust the insertion assembly 100 between the loaded position, as illustrated in FIG. 6A, and an engaged position, as illustrated in FIG. 6B, where the insertion assembly 100 is engaged with the dispensing cartridge 20. The biasing members 104, 108 may be springs that form the spring-loaded pinion gear 106 and the spring-loaded latch 102. The spring-loaded pinion gear 106 is operated to draw the dispensing cartridge 20 in an insertion direction (e.g., into the cartridge port 16).

Accordingly, when the dispensing cartridge 20 is inserted partially into the cartridge port 16, the insertion assembly 100 engages the dispensing cartridge 20 and completes the installation of the dispensing cartridge 20.

A handle 116 is coupled to an exposed end 118 of the dispensing cartridge 20. The handle 116 allows the user to overcome the outward biasing force 110 of the second biasing member 108 with the user-applied removal force 112B to withdraw the dispensing cartridge 20 in an exit direction out of the cartridge port 16. The withdrawal of the dispensing cartridge 20 readjusts the pinion gear 106 and the latch 102. The inward biasing force 114 of the first biasing member 104 returns the first biasing member 104 to a non-extended position, and the second biasing member 108 is adjusted to an extended position with the movement of the dispensing cartridge 20 out of the cartridge port 16. The adjustment of the first and second biasing members 104, 108 adjust the latch 102 and the pinion gear 106 to return to the loaded position once again.

Figure 7:
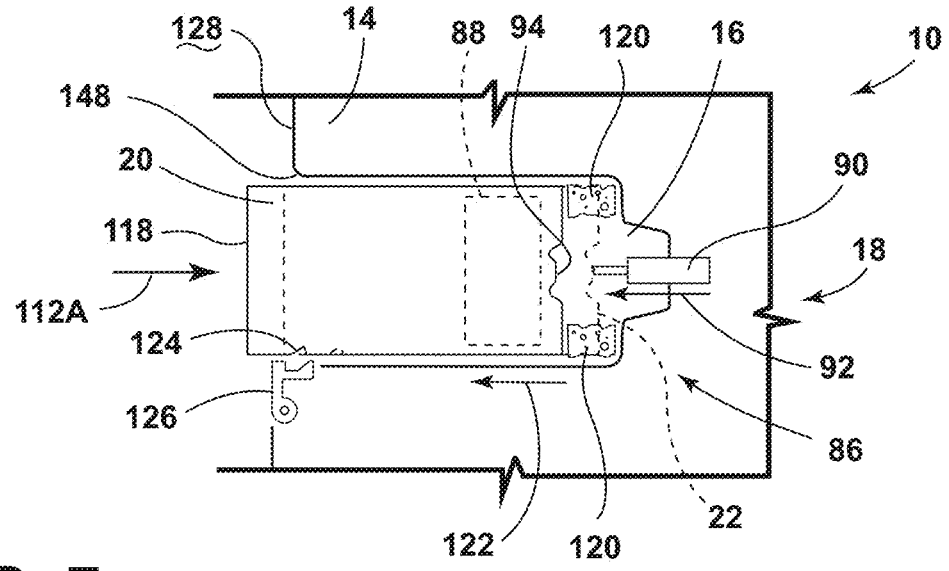
FIG. 7 is a schematic cross-sectional view of a dispensing cartridge disposed in a cartridge port with biasing members for presenting the dispensing cartridge and a latch for retaining the dispensing cartridge, according to the present disclosure.

Referring to FIG. 7, the engagement features 86 include biasing members 120 disposed within the cartridge port 16 proximate to the dispensing actuator 90. The biasing members 120 are generally sponge-like or rubber materials that elastically deform. To overcome an ejecting or outward biasing force 122 of the biasing members 120, the dispensing cartridge 20 defines a notch 124 on the outer wall 96 proximate to the exposed end 118. A latch 126 is coupled to a front surface 128 of the cabinet 14 and configured to engage the notch 124, overcoming the outward biasing force 122.

When the user inserts the dispensing cartridge 20 into the cartridge port 16, the force the user applies (e.g., the user-applied insertion force 112A) overcomes the outward biasing force 122 of the biasing members 120 until the latch 126 engages the notch 124. When the latch 126 is engaged with the dispensing cartridge 20, the engagement between the latch 126 and the notch 124 overcomes the outward biasing force 122 of the biasing members 120 to retain the dispensing cartridge 20 with the cartridge port 16. The biasing members 120 remain in a compressed state while the latch 126 is engaged. To release the dispensing cartridge 20 from the cartridge port 16, the user engages the latch 126 to disengage the latch from the notch 124. The latch 126 may be a push-push latch, may be pushed to engage and pulled to disengage, or may be another practicable configuration. When the latch 126 is disengaged, the outward biasing force 122 of the biasing members 120 causes the dispensing cartridge 20 to be adjusted partially out of the cartridge port 16 to be fully removed by the user. It is contemplated that a cover or inlay may be disposed over the latch 126 and coupled to the front surface 128 of the cabinet 14 to substantially conceal the latch 126 from view.

Figure 8:
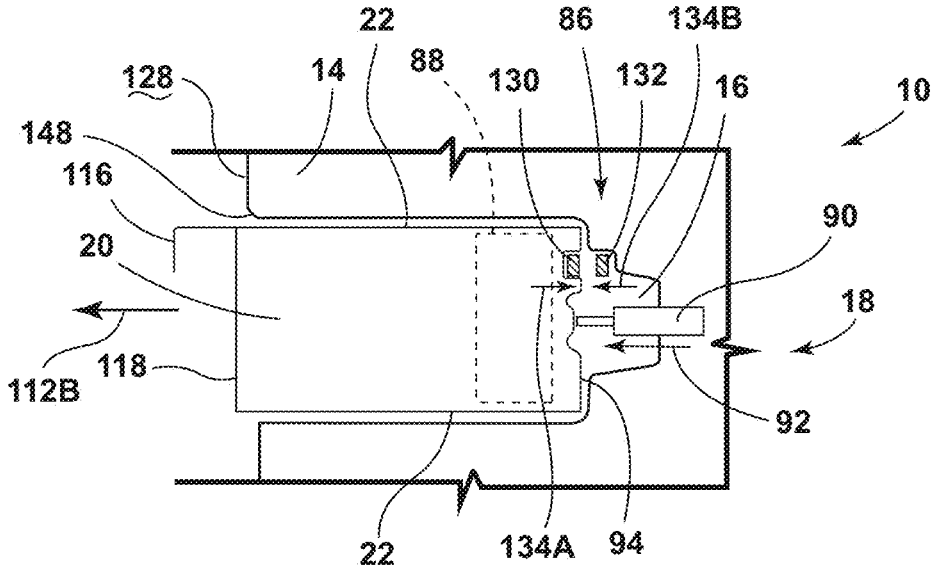
FIG. 8 is a schematic cross-sectional view of a dispensing cartridge disposed in a cartridge port with biasing members for retaining the dispensing cartridge, according to the present disclosure.

Referring to FIG. 8, the engagement features 86 include a first biasing member 130 disposed within the cartridge port 16 proximate to the dispensing actuator 90 and a second, mating biasing member 132 coupled to the insertion end 94 of the dispensing cartridge 20. The first and second biasing members 130, 132 may be configured as magnets that magnetically attract one another (e.g., opposing and attracting biasing forces 134A, 134B toward one another) to retain the dispensing cartridge 20 within the cartridge port 16.

The dispensing cartridge 20 generally includes the handle 116 extending from the exposed end 118. The user can apply the user-applied removal force 112B to the handle 116 to overcome the attracting biasing forces 134A, 134B between the first and second biasing members 130, 132 to withdraw the dispensing cartridge 20 from the cartridge port 16.

Figure 9:
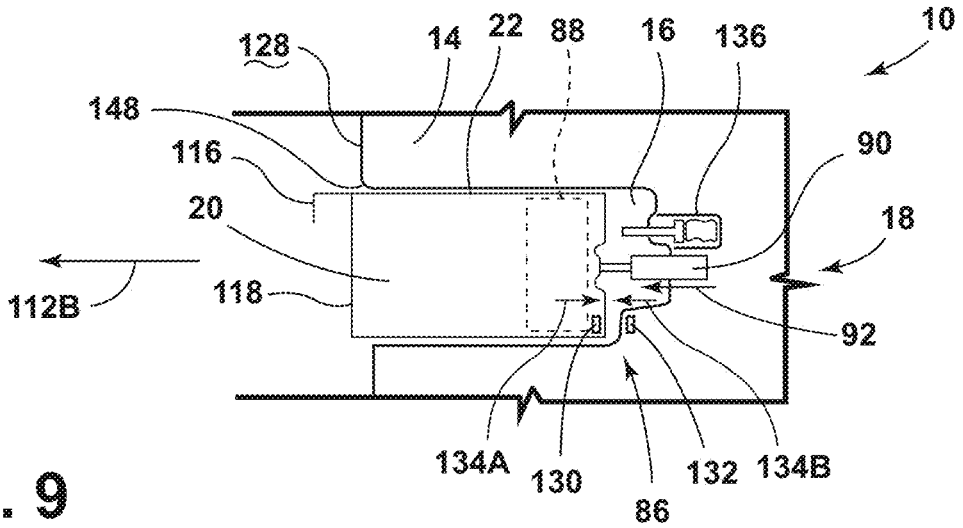
FIG. 9 is a schematic cross-sectional view of a dispensing cartridge disposed in a cartridge port with biasing members for retaining the dispensing cartridge and a pneumatic damper, according to the present disclosure.

Referring to FIG. 9, a damper, such as a pneumatic damper 136, is coupled to the cabinet 14 proximate to the dispensing actuator 90. The pneumatic damper 136 provides controlled resistance in installing the dispensing cartridge 20. The pneumatic damper 136 slows the insertion movement resulting from the attracting biasing forces 134A, 134B of the first and second biasing members 130, 132. The pneumatic damper 136 generally provides a "soft-close" experience for inserting the dispensing cartridge 20 into the cartridge port 16. The handle 116 may be used to disengage the first biasing member 130 from the second biasing member 132 and withdraw the dispensing cartridge 20 from the cartridge port 16.

Figure 10:
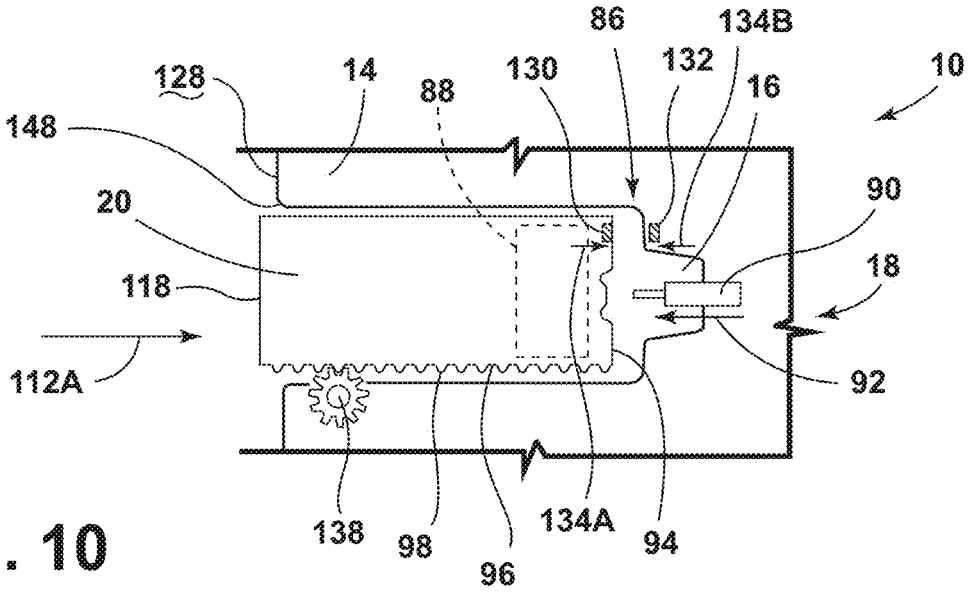
FIG. 10 is a schematic cross-sectional view of a dispensing cartridge disposed in a cartridge port with biasing members for retaining the dispensing cartridge and a viscous damper, according to the present disclosure.

Referring to FIG. 10, the engagement features 86 include the rack gear 98 extending along the entire outer wall 96 of the dispensing cartridge 20. The rack gear 98 is utilized in combination with the first and second biasing members 130, 132. The damper, such as a viscous damper 138, is coupled to the cabinet 14 adjacent to the cartridge port 16 and is configured to engage the rack gear 98. The viscous damper 138 can engage the rack gear 98 upon insertion of the insertion end 94 of the dispensing cartridge 20 into the cartridge port 16. This allows the viscous damper 138 to engage the rack gear 98 for the entire, or a substantial portion, of the insertion of the dispensing cartridge 20.

The viscous damper 138 controls the resistance of insertion of the dispensing cartridge 20. The viscous damper 138 may also provide the "soft-close" experience for inserting the dispensing cartridge 20 into the cartridge port 16. The handle 116 may be utilized by the user to pull the dispensing cartridge 20 from the cartridge port 16. The viscous damper 138 may also control the resistance of the withdrawal of the dispensing cartridge 20 from the cartridge port 16.

Figure 11A:
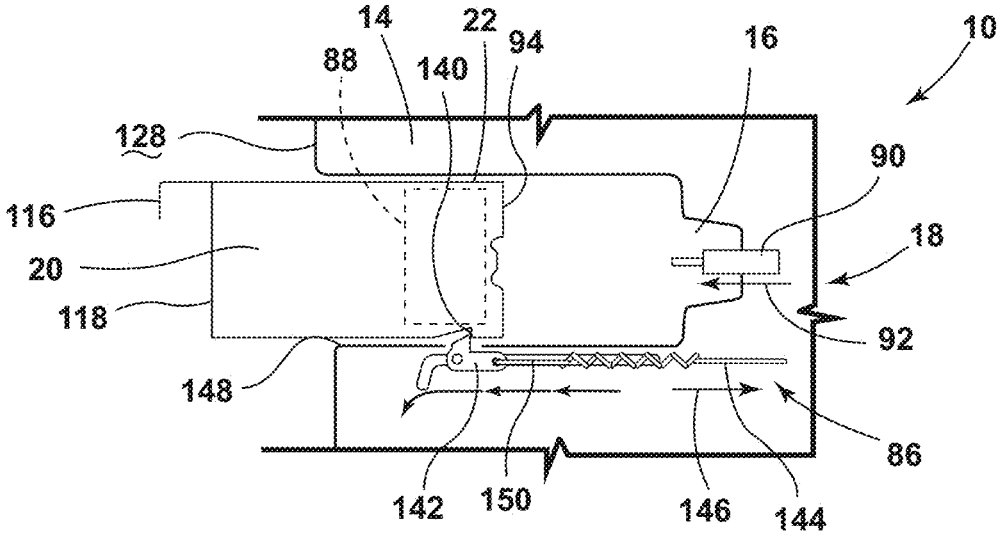
FIG. 11A is a schematic cross-sectional view of a dispensing cartridge disposed in a cartridge port with an adjustable latch for engaging the dispensing cartridge with the dispensing cartridge in a partially installed position, according to the present disclosure.
Figure 11B:
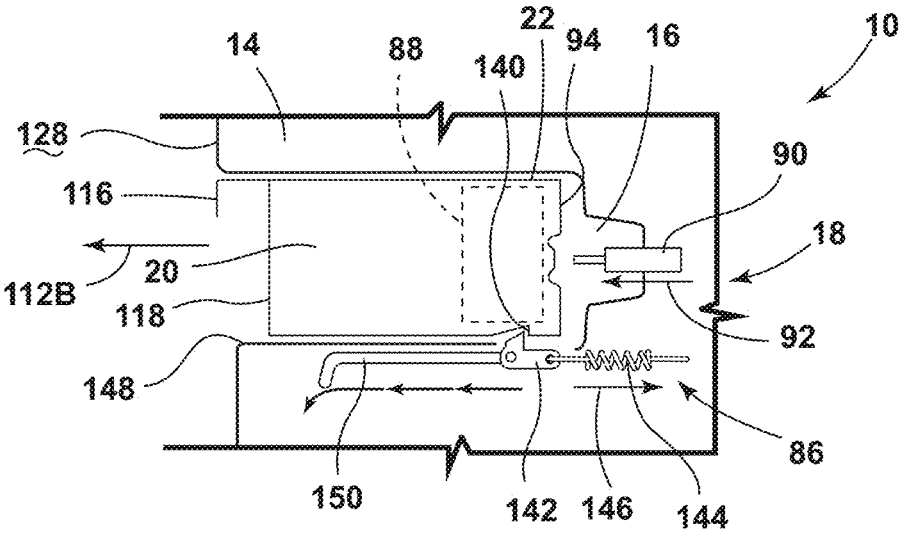
FIG. 11B is a schematic cross-sectional view of the dispensing cartridge of FIG. 11A in a fully installed position.

Referring to FIGS. 11A and 11B, the engagement features 86 include a notch 140 defined in the outer wall 96 of the dispensing cartridge 20 proximate to the insertion end 94 and a latch 142 that extends into the cartridge port 16 to engage the notch 140. The latch 142 is coupled to a biasing member 144 that extends further toward an interior of the cabinet 14. The biasing member 144 is generally configured as a spring that biases the latch 142 direction toward the interior of the cabinet 14 with an inward or seating biasing force 146.

As illustrated in FIG. 11A, when the dispensing cartridge 20 is moved into the cartridge port 16 by the user, the latch 142 engages the notch 140 and draws the dispensing cartridge 20 fully into the cartridge port 16. The engagement between the latch 142 and the notch 140 also retains or seats the dispensing cartridge 20 within the cartridge port 16 in the installed position 22. To disengage the dispensing cartridge 20 from the latch 142, the user applies a pulling force (e.g., the user-applied removal force 112B) to the handle 116 of the dispensing cartridge 20. The latch 142 translates against the seating biasing force 146 of the biasing member 144 and toward an opening 148 of the cartridge port 16.

The latch 142 is slidably engaged with a channel 150 that extends along the cartridge port 16 toward the front surface 128 of the cabinet 14. As illustrated in FIG. 11A, the latch 142 is disposed proximate to the front surface 128 when the dispensing cartridge 20 is not within the cartridge port 16. The channel 150 defines a sloped portion 152 that retains the latch 142 in the position proximate to the front surface 128 against the seating biasing force 146. The sloped portion 152 also operates to tilt the latch 142. As the dispensing cartridge 20 is moved into the cartridge port 16, the notch 140 engages the latch 142. The engagement tilts and moves the latch 142 out of the sloped portion 152. Once out of the sloped portion 152, the seating biasing force 146 operates the pull the latch 142 along the channel 150 toward the interior of the cabinet 14, and consequently, draw the dispensing cartridge 20 into the port to the installed position 22, as illustrated in FIG. 11B.

The user-applied removal force 112B applied to the handle 116 operated to pull the dispensing cartridge 20 out of the port 16. The latch 142 travels along the channel 150 and into the sloped portion 152. The change in the movement direction of the sloped portion 152 operates to tilt the latch 142, which disengages the latch 142 from notch 140, thereby allowing complete withdrawal of the dispensing cartridge 20.

Figure 12:
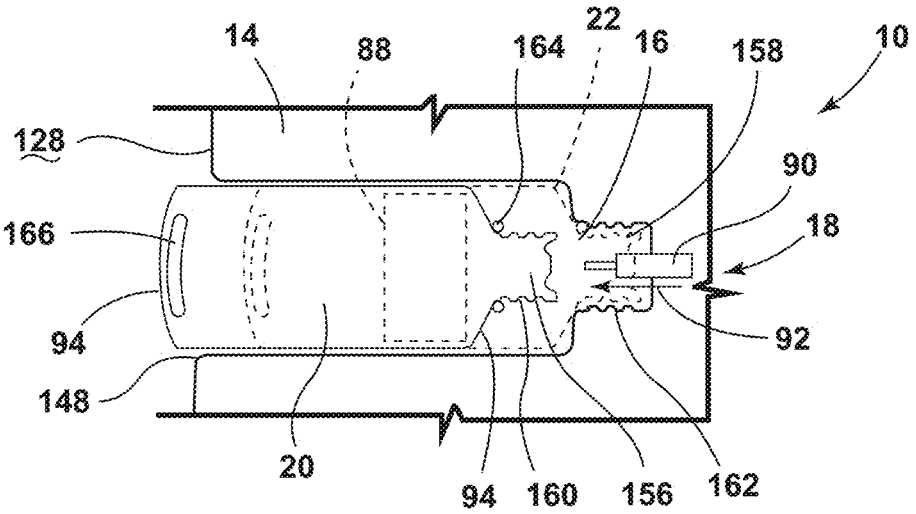
FIG. 12 is a schematic cross-sectional view of a dispensing cartridge having a threaded bayonet for rotatably coupling with a cartridge port, according to the present disclosure.

Referring to FIG. 12, the dispensing cartridge 20 may have a generally cylindrical shape. The insertion end 94 of the dispensing cartridge 20 defines a bayonet 156. The cartridge port 16 defines a channel 158 to receive the bayonet 156. The bayonet 156 defines threads 160 which rotatably engages mating threads 162 defined by the cartridge port 16. The dispensing cartridge 20 is moved in the insertion direction into the cartridge port 16 and then rotated to secure the dispensing cartridge 20. The rotation may be in a range of from about 45° to about 180°. The threads 160, 162 may be high angled threads to reduce the amount of rotation to secure the dispensing cartridge 20 within the cartridge port 16. An O-ring 164, or other sealing members, is disposed around the bayonet 156 to seal the engagement between the dispensing cartridge 20 and the cartridge port 16.

The exposed end 118 of the dispensing cartridge 20 defines a handle 166. The handle 166 provides a grasping location for the user to rotate the dispensing cartridge 20 relative to the cartridge port 16.

Referring to FIGS. 13-20, the dispensing assembly 10 includes the engagement features 86 configured as a cover 170 is rotatably coupled to the cabinet 14 proximate to the cartridge port 16. The cover 170 is operable between an opened position 172 and a closed position 174. The opened position 172 allows access to the dispensing cartridge 20 or the cartridge port 16. When in the closed position 174, the cover 170 biases the dispensing cartridge 20 into the installed position 22 and into the engagement with the dispensing actuator 90 with an inward or retaining biasing force 176.

The cover 170 is configured to rotate about a rotational axis 178, which is generally set back from the front surface 128 of the cabinet 14. In this way, when the cover 170 is in the closed position 174, the cover 170 is generally flush with the front surface 128. The rotational axis 178 is illustrated as a horizontal axis, however, the cover 170 may rotate about a vertical or angled axis without departing from the teachings herein.

Figure 13:
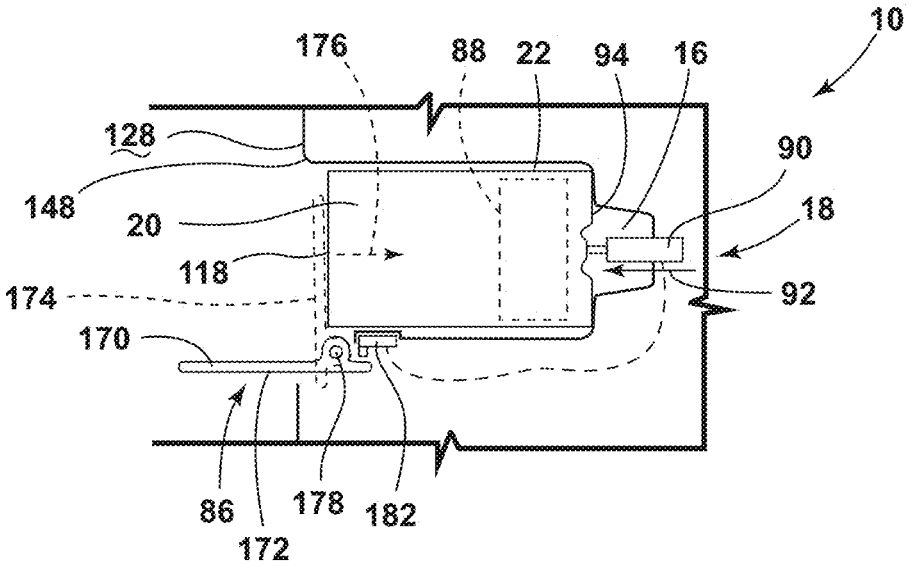
FIG. 13 is a schematic cross-sectional view of a dispensing cartridge disposed in a cartridge port with a cover that engages a switch for activating a dispensing device, according to the present disclosure.
Figure 14:
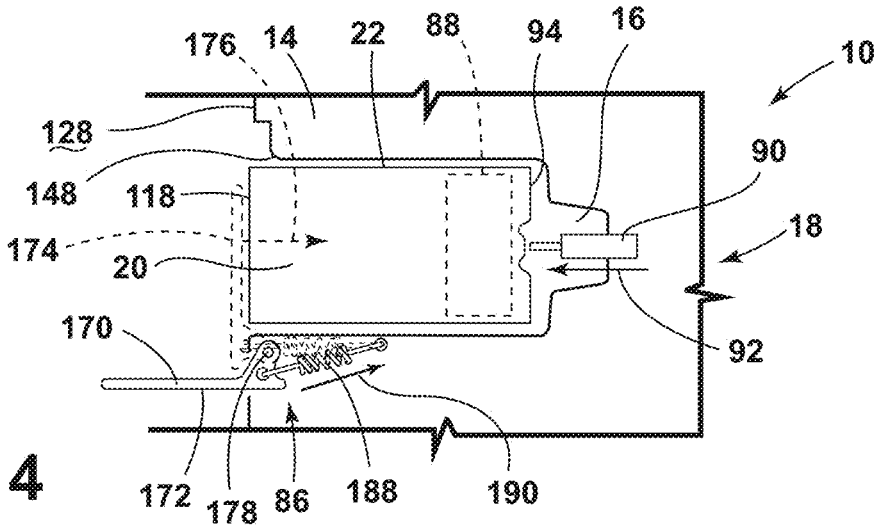
FIG. 14 is a schematic cross-sectional view of a dispensing cartridge disposed in a cartridge port with a cover biased by a biasing member, according to the present disclosure.

Referring to FIG. 13, a switch 182 is disposed on the cabinet 14 proximate to the cover 170. In the illustrated configuration, the switch 182 is disposed proximate to the rotational axis 178 of the cover 170 and within the cabinet 14. The cover 170 engages the switch 182 when the cover 170 is in the opened position 172 and disengages the switch 182 in the closed position 174 or when rotating to the closed position 174.

The switch 182 is in communication with the dispensing actuator 90. When engaged by the cover 170, the switch 182 sends a signal to activate the dispensing actuator 90. As previously stated, the dispensing actuator 90 applies the force 92 to the insertion end 94 of the dispensing cartridge 20 when activated. When activated by the switch 182, the dispensing actuator 90 applies the force 92 to the insertion end 94 of the dispensing cartridge 20 and, with the cover 170 in the opened position 172, moves the dispensing cartridge 20 partially through the opening 148 of the cartridge port 16. The user may then withdraw the dispensing cartridge 20 from the cartridge port 16. The signal from the switch 182 is separate from a signal to the dispensing actuator 90 to dose the laundry chemistry Referring to FIG. 14, the cover 170 is rotatably coupled to the cabinet 14 and coupled to a biasing member 188. The biasing member 188 extends between the cover 170 and a position more interior in the cabinet 14 relative to the rotational axis 178 of the cover 170. The biasing member 188 is coupled to the cover 170 proximate to the rotational axis 178 and extends away from the front surface 128. The biasing member 188 extends along a portion of a depth of the cartridge port 16 and provides an inward biasing force 190 on the cover 170. The biasing member 188 is generally configured as a spring. In the illustrated configuration, the biasing member 188 is coupled to the cabinet 14 proximate to a central portion of the cartridge port 16. Further, in the illustrated configuration, the cover 170 and the biasing member 188 are each coupled to the cabinet 14 below the cartridge port 16.

The engagement between the biasing member 188 and the cover 170 operates to retain the cover 170 in each of the opened position 172 and the closed position 174. Accordingly, the cover 170 is biased to the closed position 174 by the biasing member 188, which, consequently, biases the dispensing cartridge 20 toward the installed position 22. The user may rotate the cover 170 to the open position, and the biasing member 188 retains the cover 170 in the opened position 172, to allow the dispensing cartridge 20 to be manually withdrawn, partially withdrawn by the dispensing actuator 90, or a combination thereof.

Figure 15:
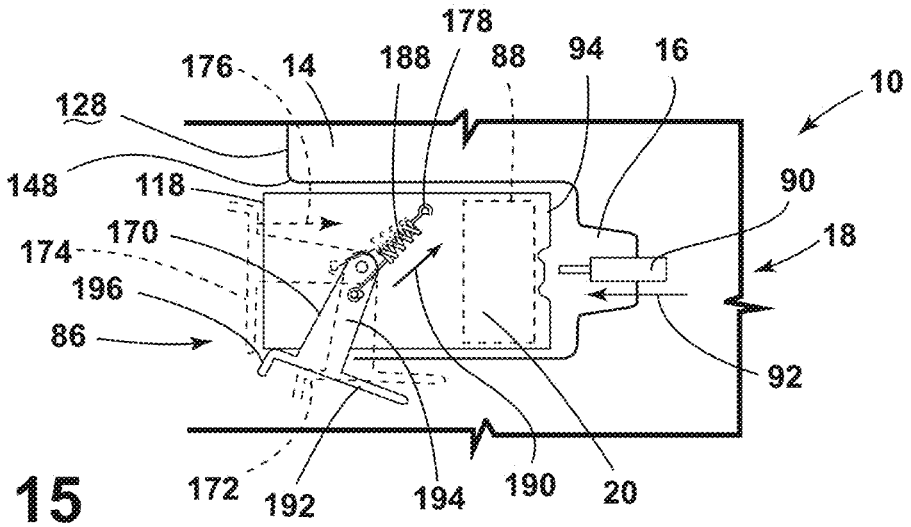
FIG. 15 is a schematic cross-sectional view of a dispensing cartridge disposed in a cartridge port with a cover operably coupled to a cabinet via biasing members, according to the present disclosure.

Referring to FIG. 15, an additional or alternative configuration of the cover 170 and the biasing member 188 is illustrated. The cover 170 includes a panel 192 and arms 194 that extend from the panel 192 and toward the interior of the cabinet 14. The cover 170 also includes a flange 196 extending in opposing direction relative to the arms 194, which provides a grasping location for the user. The user can grasp the flange 196 and swing the cover 170 between the opened position 172 and the closed position 174.

When in the closed position 174, the panel 192 is disposed over the opening 148 of the cartridge port 16 to provide the retaining biasing force 176 to retain the dispensing cartridge 20 in the installed position 22. When in the opened position 172, the cover 170 is disposed substantially within the cabinet 14, for example, below the cartridge port 16. The flange 196 may remain exposed to be grasped by the user to pull the cover 170 over the dispensing cartridge 20 or an empty cartridge port 16. The remainder of the cover 170 may be substantially disposed and obscured within the cabinet 14.

The biasing member 188 is coupled to the cabinet 14 proximate an upper central location of the cartridge port 16. The extension of the biasing member 188 between the upper central location and the arms 194 provides for the swinging, rotational motion of the cover 170 about the rotational axis 178 between the opened and closed positions 172, 174. The cover 170 may be substantially flush with the front surface 128 of the cabinet 14 when in the opened and closed positions 172, 174.

Figure 16:
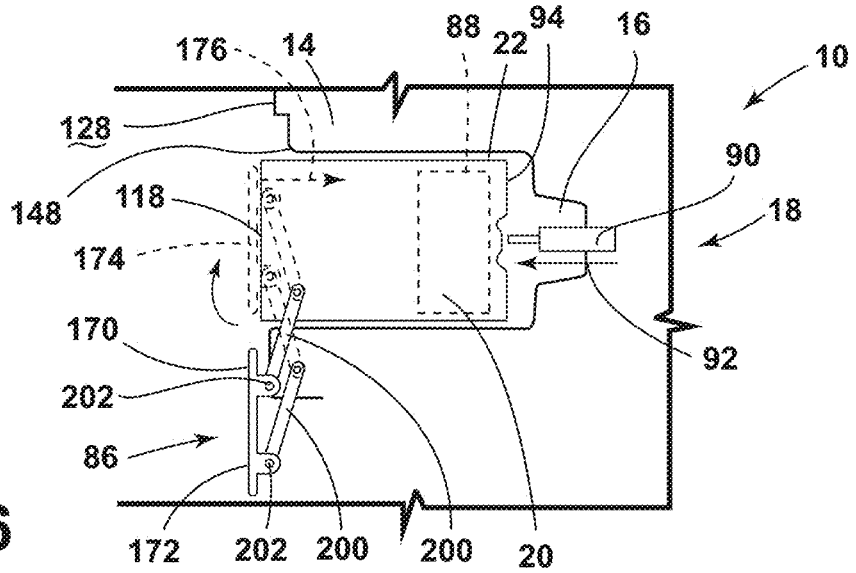
FIG. 16 is a schematic cross-sectional view of a dispensing cartridge disposed in a cartridge port with a cover coupled to a cabinet via linkages, according to the present disclosure.

Referring to FIG. 16, the cover 170 is rotatably coupled to the cabinet 14 via linkages 200. The cover 170 includes tabs 202 extending toward the interior of the cabinet 14. The linkages 200 are rotatably coupled to the cabinet 14 and the tabs 202 of the cover 170. In the illustrated configuration, each side of the cover 170 (e.g., on each side of the cartridge port 16) is coupled to the cabinet 14 via two linkages 200. Due to the linkages 200, the cover 170 is maintained in a position substantially parallel to the front surface 128 of the cabinet 14 as the cover 170 rotates between the opened and closed positions 172, 174.

Figure 17:
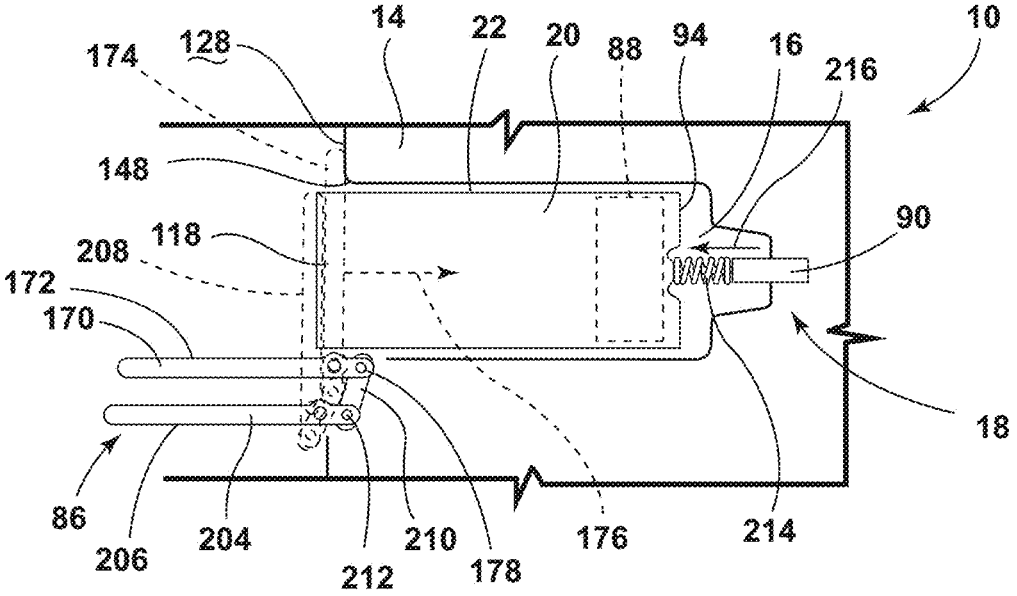
FIG. 17 is a schematic cross-sectional view of a dispensing cartridge disposed in a cartridge port with a cover operably coupled to a handle, according to the present disclosure.

Referring to FIG. 17, the cover 170 is operably coupled to the cabinet 14 and a handle 204. A linkage 210 extends between the cover 170 and the handle 204. The handle 204 is also configured to rotate between an opened position 206 and a closed position 208 with the rotation of the cover 170. The rotational axis 178 of the cover 170 is offset from a rotational axis 212 of the handle 204. The handle 204 provides a mechanical advantage for closing or clamping the cover 170 over the opening 148 of the cartridge port 16. The user can rotate the handle 204 to the selected position and the cover 170 will be rotated concurrently.

According to various aspects, a biasing member 214 is coupled to the dispensing actuator 90. An outward or ejecting biasing force 216 of the biasing member 214 is applied to the insertion end 94 of the dispensing cartridge 20 when the dispensing cartridge 20 is in the cartridge port 16. The cover 170 and the handle 204 bias the dispensing cartridge 20 into the installed position 22, overcoming the ejecting biasing force 216 of the biasing member 214. The mechanical advantage provided by the handle 204 provides greater convenience for the user in overcoming the ejecting biasing force 216 of the biasing member 214. When the handle 204 is rotated to the opened position 206, the cover 170 is also rotated to the opened position 172, allowing the ejecting biasing force 216 of the biasing member 214 to act on the dispensing cartridge 20 to at least partially move the dispensing cartridge 20 through the opening 148.

Figure 18:
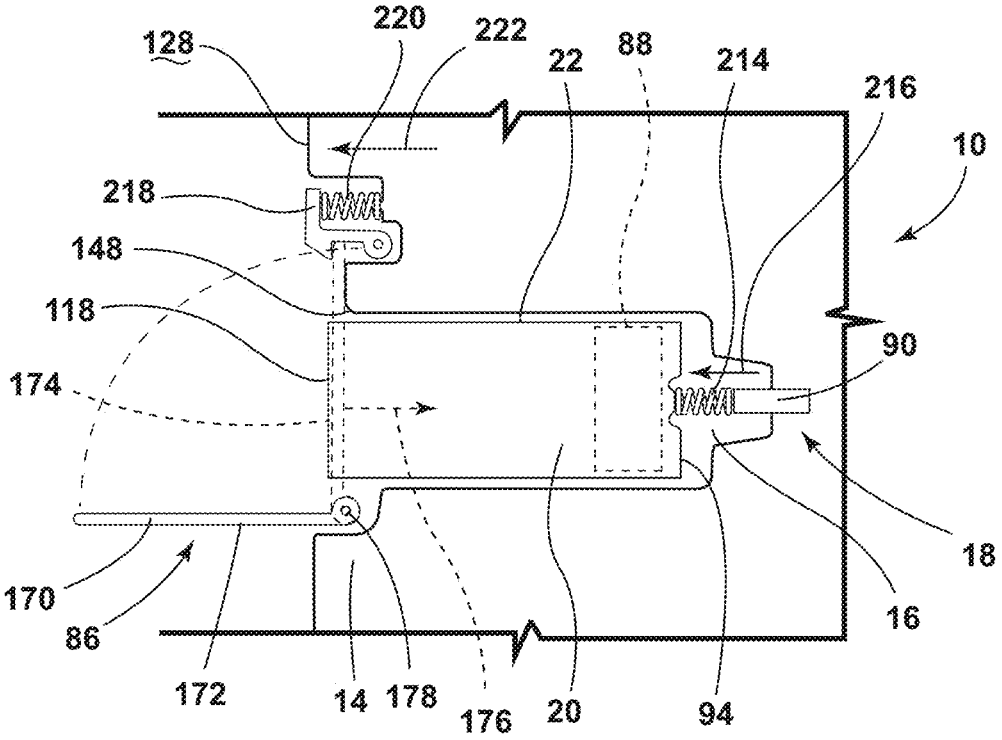
FIG. 18 is a schematic cross-sectional view of a dispensing cartridge disposed in a cartridge port with a cover that engages a latch, according to the present disclosure.

Referring to FIG. 18, the cover 170 is rotatably coupled to the cabinet 14 on a first side of the cartridge port 16 and a latch 218 is coupled to the front surface 128 of the cabinet 14 on an opposing side of the cartridge port 16. The latch 218 is coupled to the cabinet 14 via a biasing member 220, which provides an outward latch biasing force 222 that biases the latch 218 away from the front surface 128. When biased outward, the latch 218 is generally substantially flush with the front surface 128 of the cabinet 14. The latch 218 may be pressed, to compress the biasing member 220, to engage or disengage the cover 170.

The cover 170 may engage the latch 218 to retain the cover in the closed position 174. When the cover 170 is engaged with the latch 218, the cover 170 overcomes the ejecting biasing force 216 of biasing member 214 to compress the biasing member 214 coupled to the dispensing actuator 90. The cover 170 also maintains the engagement between the dispensing actuator 90 and the dispensing cartridge 20. The latch 218 may be a push-push latch or another similar configuration.

Figure 19A:
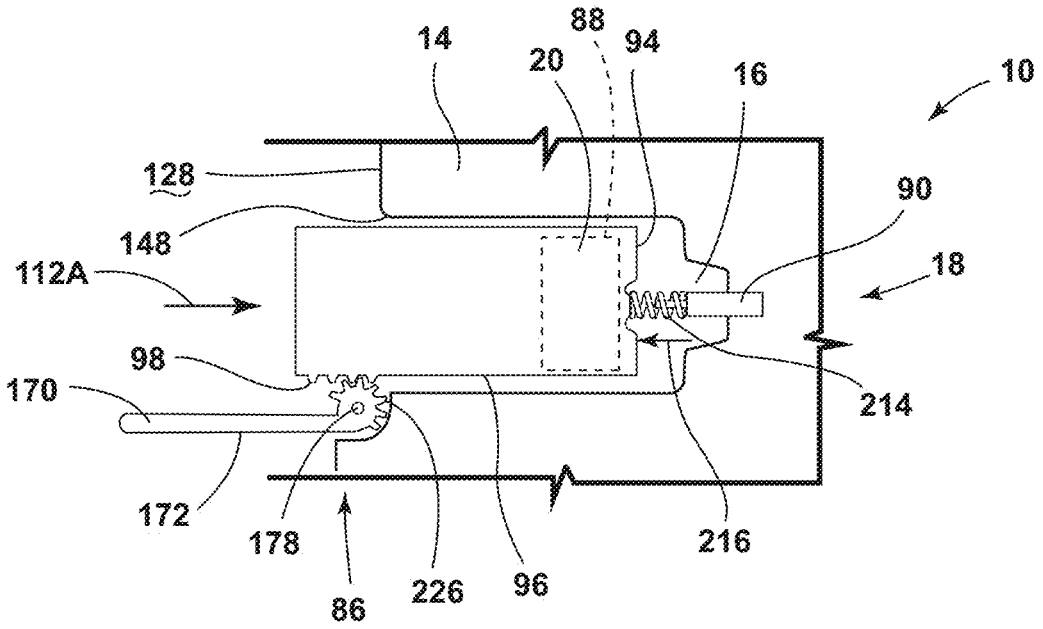
FIG. 19A is a schematic cross-sectional view of a dispensing cartridge disposed in a cartridge port with a cover having gears that engage a cartridge gear for adjusting a position of the dispensing cartridge with the cover in an opened position, according to the present disclosure.
Figure 19B:
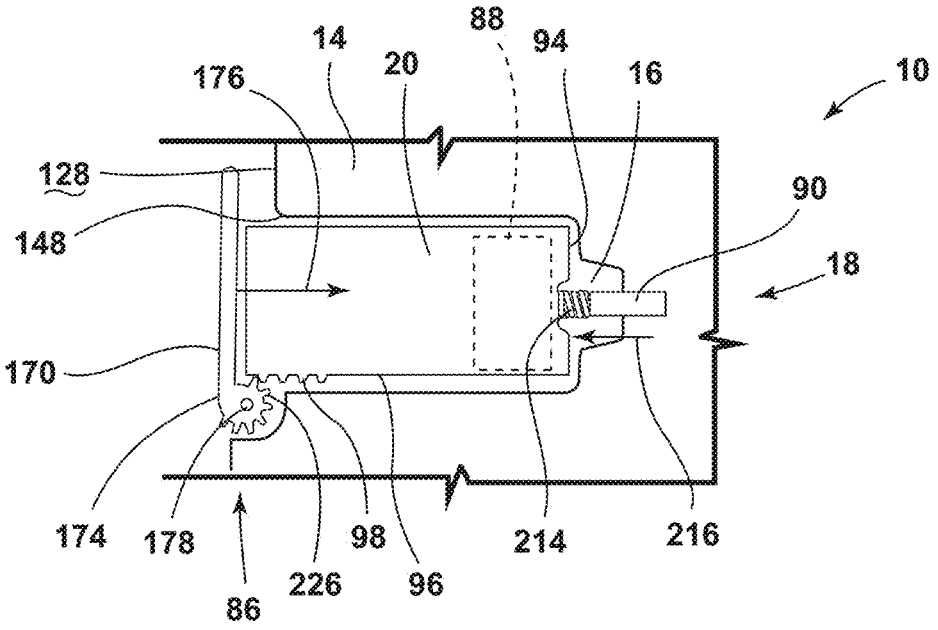
FIG. 19B is a schematic cross-sectional view of the dispensing cartridge and the cover of FIG. 19A with the cover in a closed position and the dispensing cartridge in a fully installed position.

Referring to FIGS. 19A and 19B, the outer wall 96 of the dispensing cartridge 20 defines the rack gear 98 proximate to the exposed end 118. The cover 170 defines a cover gear 226 that engages the rack gear 98 when the dispensing cartridge 20 is partially inserted into the cartridge port 16, as illustrated in FIG. 19A. Once the rack gear 98 engages the cover gear 226, the user can rotate the cover 170 toward the closed position 174. As the cover 170 is rotated, the cover gear 226 engages the rack gear 98 to further insert the dispensing cartridge 20 into the cartridge port 16, as illustrated in FIG. 19B. The engagement between the rack gear 98 and the cover gear 226 overcomes the ejecting biasing force 216 of the biasing member 214 and retains the dispensing cartridge 20 in the cartridge port 16.

When the user rotates the cover 170 to the opened position 172, the engagement between the rack gear 98 and the cover gear 226 operates to partially withdraw the dispensing cartridge 20 from the cartridge port 16. The biasing member 214 may operate to press on the insertion end 94 of the dispensing cartridge 20 to further push the dispensing cartridge 20 through the opening 148 of the cartridge port 16 to be fully withdrawn by the user.

Figure 20A:
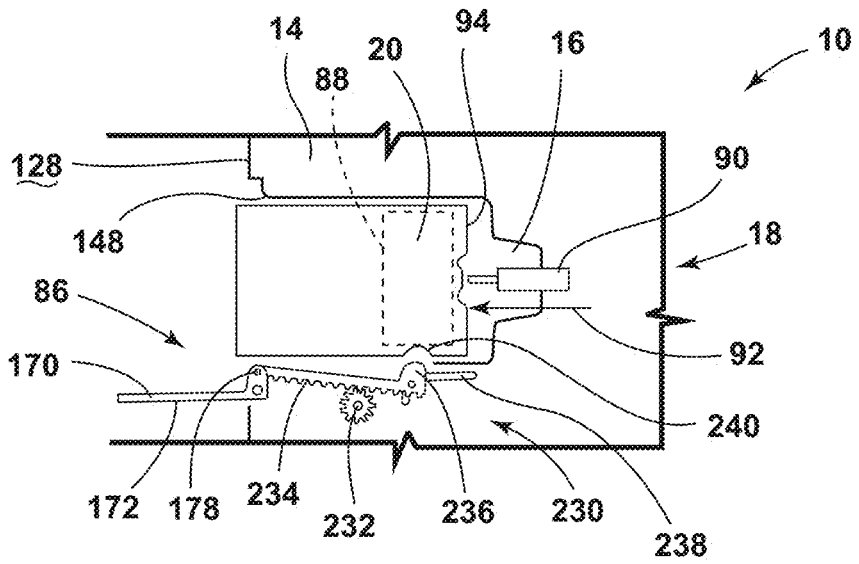
FIG. 20A is a schematic cross-sectional view of a dispensing cartridge disposed in a cartridge port with an automatic adjustment assembly with the dispensing cartridge in a partially installed position, according to the present disclosure.
Figure 20B:
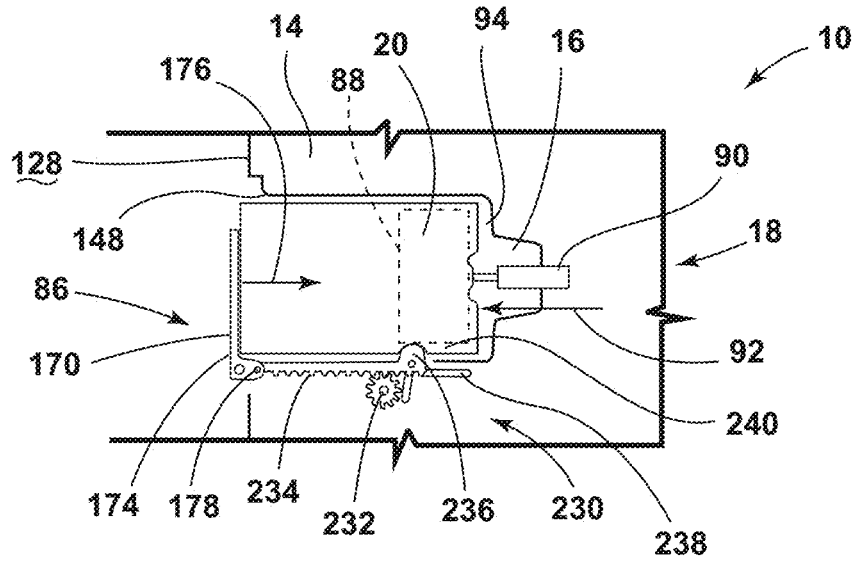
FIG. 20B is a schematic cross-sectional view of the dispensing cartridge and the cover of FIG. 20A with the cover in a closed position and the dispensing cartridge in a fully installed position.

Referring again to FIG. 5, as well as FIGS. 20A and 20B, in an additional or alternative configuration, the engagement features 86 include an automatic adjustment assembly 230. The automatic adjustment assembly 230 is in communication with the controller 72 to automatically adjust a position of the dispensing cartridge 20, a position of the cover 170, or a combination thereof. The controller 72 communicates with an actuator 232, such as, for example, a servomotor. The actuator 232 is operably engaged with a guide feature 234 that extends along a depth of the cartridge port 16. The guide feature 234 may define a rack gear or other engaging feature for engaging the actuator 232 and for adjusting a position relative to the actuator 232.

A protrusion 236 is defined on one end of the guide feature 234, which is generally the side proximate to the dispensing actuator 90. The end of guide feature 234 engages a channel 238 to guide the adjustment of the protrusion 236 relative to the dispensing cartridge 20. The protrusion 236 selectively engages a notch 240 defined in the outer wall 96 of the dispensing cartridge 20. When the dispensing cartridge 20 is inserted into the cartridge port 16, the dispensing cartridge 20 is moved in the insertion direction until the protrusion 236 engages the notch 240. The actuator 232 then adjusts the guide feature 234 in the insertion direction and, consequently, draws the dispensing cartridge 20 further into the cartridge port 16.

On an end of the guide feature 234 opposite the protrusion 236, the guide feature 234 is rotatably coupled to the cover 170. As the guide feature 234 engages the dispensing cartridge 20, the guide feature 234 and the actuator 232 operate to adjust the cover 170 between the opened and closed positions 172, 174. For example, the guide feature 234 is disposed at an angle prior to insertion of the dispensing cartridge 20, as illustrated in FIG. 20A. As the dispensing cartridge 20 is drawn into the cartridge port 16, the guide feature 234 may rotate or adjust, causing the rotation of the cover 170 to the closed position 174, as illustrated in FIG. 20B. To withdraw the dispensing cartridge 20, the actuator 232 adjusts the guide feature 234 to rotate the cover 170 to the opened position 172, withdraw the dispensing cartridge 20, and disengage the protrusion 236 from the notch 240. Accordingly, the automatic adjustment assembly 230 operates to automatically move the dispensing cartridge 20 and the cover 170. The automatic adjustment assembly 230 may be activated by the user through a user interface 242 (FIG. 5).

Figure 21A:
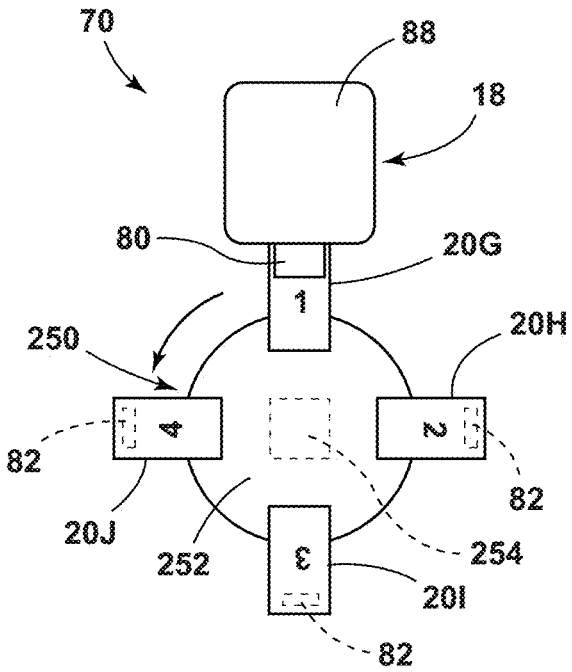
FIG. 21A is a schematic top plan view of an engagement assembly having dispensing cartridges coupled to a rotatable carousel with the carousel in a first position, according to the present disclosure.
Figure 21B:
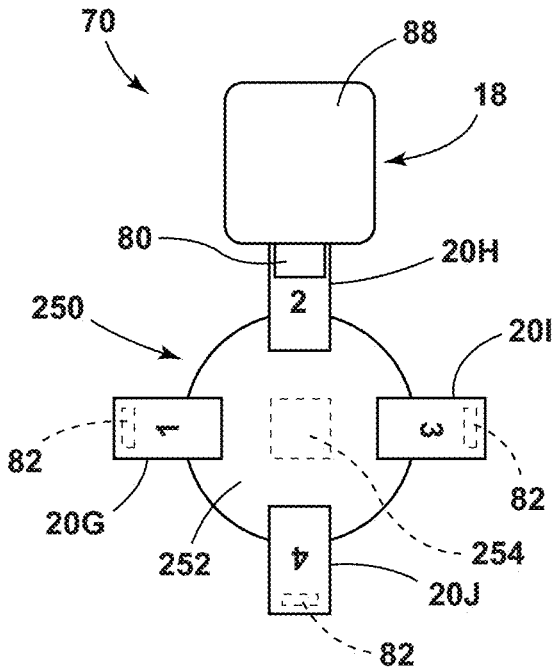
FIG. 21B is a schematic top plan view of the engagement assembly of FIG. 21A with the carousel in a second position.
Figure 22:
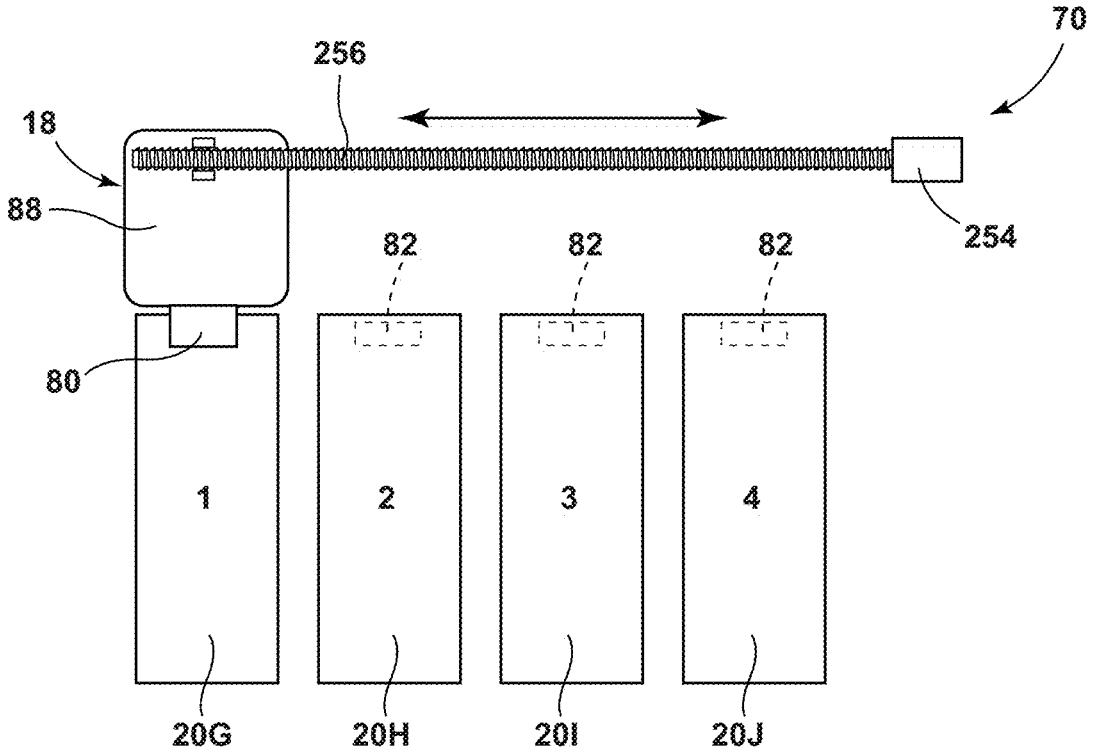
FIG. 22 is a schematic top plan view of an engagement assembly having a rail assembly with a dispensing device coupled thereto, according to the present disclosure.

Referring to FIGS. 21A-22, as previously stated, multiple dispensing cartridges 20 can be positioned within the laundry appliance 12 at a single time. Once the dispensing cartridges 20 are installed in the cartridge port 16, the controller 72 selectively operates the dispensing device 18, including at least one of the pump 88 and the dispensing actuator 90, to dispense the laundry chemistry from the selected dispensing cartridge 20. The dispensing system 70 generally includes an engagement assembly 250 in communication with the controller 72. The engagement assembly 250 is operably coupled with at least one of the dispensing device 18 and the dispensing cartridges 20 to adjust the position of the respective component (e.g., the dispensing device 18 or the dispensing cartridges 20).

Referring to FIGS. 21A and 21B, the engagement assembly 250 includes a carousel 252 coupled to each of the dispensing cartridges 20. The carousel 252 is configured to be rotated by a motor 254. The dispensing cartridges 20 are arranged in a circular or oblong configuration around the carousel 252. In this configuration, the exposed end 118 is the end engaged by the dispensing device 18, and the insertion end 94 is coupled to the carousel 252.

The carousel 252 is rotated relative to the stationary dispensing device 18 to bring the selected dispensing cartridge 20 into communication with the dispensing device 18. For example, in FIGS. 21A and 21B four dispensing cartridges 20G-20J are illustrated, with the dispensing cartridge 20G initially engaged with the dispensing device 18 in FIG. 21A. When the carousel 252 is rotated, the adjacent dispensing cartridge 20H is engaged with the dispensing device 18.

The dispensing device 18 is illustrated as the pump 88. Accordingly, the dispensing cartridges 20 selectively engage the pump 88 when rotated to the position adjacent to the pump 88. However, the pump 88 may be included inside each dispensing cartridge 20. In such configurations, the dispensing device 18 is the dispensing actuator 90, which is configured to engage the pump 88 disposed within the selected dispensing cartridges 20.

The identification device 80 is generally coupled to the dispensing device 18. Each dispensing cartridge 20 includes the identification feature 82 configured to be read by the identification device 80. The carousel 252 rotates the dispensing cartridges 20 to the position adjacent to the identification device 80. The identification device 80 then reads the information from the identification feature 82, which can be communicated to the controller 72. Once the identification device 80 and/or the controller 72 determines that the dispensing cartridge 20 adjacent to the dispensing device 18 includes the selected laundry chemistry, the carousel 252 and the motor 254 are deactivated. The dispensing device 18 then engages the dispensing cartridge 20 to dispense the selected laundry chemistry.

Referring to FIG. 22, in various examples, the dispensing cartridges 20 remain stationary and the dispensing device 18 is adjusted between multiple positions to engage the selected dispensing cartridge 20. In such configurations, the engagement assembly 250 includes a rail 256 operably coupled with the motor 254. The dispensing device 18 is slidably engaged with the rail 256 and translated along the rail 256 by the motor 254. It is also contemplated that the movable dispensing device 18 may be used to adjust the position of the dispensing device 18 relative to the nesting portion 24 and the insert portion 26 to selectively engage the first and second chemistry reservoirs 44, 46.

The identification device 80 operates in a similar manner as discussed herein to identify the contents of the dispensing cartridges 20 through the identification feature 82. Once the identification device 80 determines that the dispensing device 18 is disposed adjacent to the dispensing cartridge 20 with the selected laundry chemistry, the motor 254 is deactivated and the dispensing device 18 engages the selected dispensing cartridge 20.

Accordingly, when multiple dispensing cartridges 20 are disposed within the laundry appliance 12, the dispensing system 70 determines information about the dispensing cartridges 20 to allow the dispensing device 18 to engage the selected dispensing cartridge 20. Further, the dispensing system 70 operates to dispense the selected laundry chemistry, as well as the selected volume of laundry chemistry, into the treatment chamber of the laundry appliance 12. Moreover, when the dispensing cartridge 20 includes the nesting portion 24 and the insert portion 26, the dispensing system 70 can differentiate between the two laundry chemistries through the identification features 82 and can dispense the selected volume based on the type of laundry chemistry.

Use of the present device may provide for a variety of advantages. For example, the cabinet 14 can define the cartridge port 16 to selectively receive multiple configurations of the dispensing cartridge 20. Multiple combinations of different sized dispensing cartridges 20 may be inserted into the same cartridge port 16. Further, the dispensing cartridge 20 may include two different types of chemistries, which may be housed in different volumes through the nesting portion 24 and the insert portion 26. Also, the insert portion 26 may be an interchangeable section of the dispensing cartridge 20. Additionally, the dispensing assembly 10 may include a variety of engagement features 86 to withdraw, insert, and/or retain the dispensing cartridge 20 within the cartridge port 16 to overcome the force applied by the dispensing actuator 90. These engagement features 86 include various engagements between the dispensing cartridge 20 and the cabinet 14, as well as the use of the cover 170 to bias the dispensing cartridge 20 into the cartridge port 16. Moreover, the dispensing assembly 10 may include engagement features 86 that assist or automatically insert and/or withdraw the dispensing cartridge 20 relative to the dispensing the cartridge port 16.

Additionally, the dispensing cartridges 20 may be a bulk cartridge used for dosing a predefined amount of laundry chemistry and may also be used with single-dose inserts received within the dispensing cartridge 20. Further, the dispensing system 70 may adjust the position of one or more dispensing cartridges 20 and/or the dispensing device 18 to provide engagement between the dispensing device 18 and the selected dispensing cartridge 20. The engagement assembly 250 may include the carousel 252 for rotating the dispensing cartridges 20 relative to the dispensing device 18. Additionally or alternatively, the engagement assembly 250 may include the rail 256 for adjusting the position of the dispensing device 18 relative to the stationary dispensing cartridges 20. The dispensing system 70 may also include the identification device 80 that reads or otherwise obtains information from the identification feature 82 on each of the dispensing cartridges 20. In this way, the dispensing system 70 may read the identification feature 82 to derive a variety of information about each dispensing cartridge 20 and dispense from the selected dispensing cartridge 20. Additional benefits or advantages may be realized and/or achieved.

According to another aspect of the present disclosure, a dispensing assembly for a laundry appliance includes a cabinet defining a cartridge port. A dispensing device is coupled to the cabinet and extends into the cartridge port. A dispensing cartridge is selectively received by the cartridge port. The dispensing cartridge selectively engages the dispensing device when in an installed position within the cartridge port. The dispensing cartridge includes a nesting portion configured to house a first laundry chemistry. An insert portion is configured to house a second laundry chemistry. The nesting portion selectively receives the insert portion.

According to another aspect, the nesting portion includes an engagement panel defining a handle along an edge thereof.

According to another aspect, the insert portion is selectively coupled to the engagement panel.

According to another aspect, the insert portion is selectively seated within a supplemental receiver defined by the nesting portion.

According to another aspect, the insert portion is an interchangeable section of the dispensing cartridge.

According to another aspect, a cover is coupled to the cabinet proximate to the cartridge port via a plurality of linkages. The cover remains in a position parallel to a front surface of the cabinet as the cover is moved between an opened position and a closed position relative to the cartridge port.

According to another aspect, a cover is rotatably coupled to the cabinet proximate to the cartridge port. A latch is coupled to the cabinet on an opposing side of the cartridge port relative to the cover. The cover engages the latch when in a closed position 174 to retain the dispensing cartridge within the cartridge port.

According to another aspect, a dispensing assembly for a laundry appliance includes a cabinet defining a cartridge port. A dispensing cartridge is selectively received in the cartridge port. A dispensing actuator is coupled to the cabinet and configured to selectively engage the dispensing cartridge when the dispensing cartridge is in an installed position in the cartridge port. A cover is operably coupled to the cabinet. The cover is operable between a closed position and an opened position to selectively allow access to the dispensing cartridge. The cover biases the dispensing cartridge into the installed position when the cover is in the closed position.

According to another aspect, a handle is coupled to the cover via a linkage. The handle rotates about a rotational axis that is offset from a rotational axis of the cover. The handle is operable between an opened position and a closed position to provide a mechanical advantage for operating the cover.

According to another aspect, a switch is in communication with the dispensing actuator. The cover engages the switch when the cover is in the opened position 172. The dispensing actuator engages the dispensing cartridge to move the dispensing cartridge toward an opening of the cartridge port in response to engagement of the switch.

According to another aspect, a biasing member is coupled to the dispensing actuator. The cover overcomes an outward biasing force of the biasing member to retain the dispensing cartridge within the cartridge port when the cover is in the closed position. The outward biasing force moves the dispensing cartridge toward an opening of the cartridge port when the cover is in the opened position.

According to another aspect, a biasing member is coupled to the cabinet proximate to the cartridge port. The biasing member extends along a portion of a depth of the cartridge port and is coupled with the cover. An inward biasing force of the biasing member is configured to retain the cover in the opened position and the closed position.

According to another aspect, a side of the dispensing cartridge proximate to the cover defines a first gear. The cover defines a second gear that engages the first gear to adjust a position of the dispensing cartridge relative to the cartridge port as the cover is operated between the closed position and the opened position.

According to yet another aspect, a dispensing system for a laundry appliance includes a first dispensing cartridge having a first chemistry reservoir. A second dispensing cartridge has a second chemistry reservoir. The second dispensing cartridge is disposed proximate to the first dispensing cartridge. A dispensing device is in selective communication with the first chemistry reservoir and the second chemistry reservoir. An engagement assembly is operably coupled to at least one of the dispensing device, the first dispensing cartridge, and the second dispensing cartridge. The engagement assembly is operable between a first position and a second position. A controller is in communication with the engagement assembly. The controller adjusts the engagement assembly between the first position and the second position to selectively engage the dispensing device with a selected one of the first dispensing cartridge and the second dispensing cartridge.

According to another aspect, the engagement assembly includes a carousel coupled to the first dispensing cartridge and the second dispensing cartridge and a motor operably coupled to the carousel.

According to another aspect, the controller activates the motor to rotate the carousel relative to the dispensing device. A position of the first dispensing cartridge and a position of the second dispensing cartridge are adjusted relative to the dispensing device with rotation of the carousel.

According to another aspect, the engagement assembly includes a rail and a motor. The dispensing device is operably coupled to the rail.

According to another aspect, the controller translates the dispensing device along the rail to adjust a position of the dispensing device relative to the first dispensing cartridge and the second dispensing cartridge.

According to another aspect, an identification device is operably coupled to the dispensing device. Each of the first dispensing cartridge and the second dispensing cartridge include an identification feature. The identification device reads the identification feature and communicates information from the identification feature to the controller.

According to another aspect, the dispensing device is at least one of a pump and a dispensing actuator configured to engage the pump.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A dispensing assembly for an appliance, comprising:

a cabinet defining a cartridge port;

a dispensing device coupled to the cabinet and extending into the cartridge port; and a dispensing cartridge selectively received by the cartridge port, wherein the dispensing cartridge selectively engages the dispensing device when in an installed position within the cartridge port, and wherein the dispensing cartridge includes:

a nesting portion defining a first reservoir configured to house a first laundry chemistry, wherein an outer wall of the nesting portion at least partially defines a supplemental receiver; and an insert portion defining a second reservoir configured to house a second laundry chemistry, wherein the nesting portion selectively receives the insert portion, and wherein the insert portion is selectively seated in the supplemental receiver laterally adjacent to at least a portion of the nesting portion, and further wherein the nesting portion is a first size greater than a second size of the insert portion to form the supplemental receiver and define a greater volume in the first reservoir compared to the second reservoir to hold different volumes of the first and second laundry chemistries that are configured to be dispensed in different quantities during a wash cycle.

2. The dispensing assembly of claim 1, wherein the nesting portion includes an engagement panel defining a handle along an edge thereof.

3. The dispensing assembly of claim 2, wherein the insert portion is selectively coupled to the engagement panel.

4. The dispensing assembly of claim 1, wherein the outer wall of the nesting portion extends along at least a portion of a perimeter of the insert portion when the insert portion is selectively seated within the supplemental receiver defined by the nesting portion, and wherein the nesting portion has a greater width than the insert portion to at least partially define the greater volume in the first reservoir.

5. The dispensing assembly of claim 1, wherein the insert portion is selectively removable from the dispensing cartridge.

6. The dispensing assembly of claim 1, further comprising:

a cover coupled to the cabinet proximate to the cartridge port via a plurality of linkages, wherein the cover remains in a position parallel to a front surface of the cabinet as the cover is moved between an opened position and a closed position relative to the cartridge port.

7. The dispensing assembly of claim 1, further comprising:

a cover rotatably coupled to the cabinet proximate to the cartridge port; and a latch coupled to the cabinet on an opposing side of the cartridge port relative to the cover, wherein the cover engages the latch when in a closed position to retain the dispensing cartridge within the cartridge port.

8. The dispensing assembly of claim 1, wherein the nesting portion and the insert portion have mating features for coupling the insert portion to the nesting portion.

9. A dispensing assembly for an appliance, comprising:

a cabinet defining a cartridge port;

a dispensing cartridge selectively received in the cartridge port;

a dispensing actuator coupled to the cabinet and configured to selectively engage the dispensing cartridge when the dispensing cartridge is in an installed position in the cartridge port, wherein the dispensing actuator extends into the cartridge port at an inner end thereof and is configured to apply a force to an insertion end of the dispensing cartridge when activated;

a biasing member coupled to the dispensing actuator, being separate from the dispensing cartridge, and being disposed adjacent to the dispensing actuator to impart an outward biasing force on the insertion end of the dispensing cartridge, wherein the outward biasing force and the force of the dispensing actuator move the dispensing cartridge through an opening of the cartridge port for cartridge removal; and a cover operably coupled to the cabinet, wherein the cover is operable between a closed position and an opened position to selectively allow access to the dispensing cartridge, and wherein the cover overcomes the outward biasing force of the biasing member and the force of the dispensing actuator and biases the dispensing cartridge into the installed position when the cover is in the closed position.

10. The dispensing assembly of claim 9, further comprising:

a handle coupled to the cover via a linkage, wherein the handle rotates about a handle rotational axis that is offset from a cover rotational axis of the cover, and wherein the handle is operable between an opened position and a closed position to provide a mechanical advantage for operating the cover.

11. The dispensing assembly of claim 9, wherein an outer wall of the dispensing cartridge proximate the cover defines a first gear, and wherein the cover defines a second gear that engages the first gear to adjust a position of the dispensing cartridge relative to the cartridge port as the cover is operated between the closed position and the opened position.

12. A dispensing system for an appliance, comprising:

a first dispensing cartridge having a first chemistry reservoir;

a second dispensing cartridge having a second chemistry reservoir, wherein the second dispensing cartridge is disposed proximate to the first dispensing cartridge;

an identification feature coupled to each of the first and second dispensing cartridges, respectively;

an identification device configured to determine information about the first and second dispensing cartridges from the identification features, the information including an initial amount of chemistry and a type of chemistry in the respective cartridge, a size of the respective cartridge, and whether the respective cartridge is a bulk-dispensing cartridge or a single-dose cartridge;

a dispensing device in selective communication with the first chemistry reservoir and the second chemistry reservoir, wherein the identification device is coupled with the dispensing device;

an engagement assembly operably coupled to at least one of the dispensing device, the first dispensing cartridge, and the second dispensing cartridge, wherein the engagement assembly is operable between a first position and a second position; and a controller in communication with the engagement assembly, wherein the controller adjusts the engagement assembly between the first position and the second position to selectively engage the dispensing device with a selected one of the first dispensing cartridge and the second dispensing cartridge.

13. The dispensing system of claim 12, wherein the engagement assembly includes a carousel coupled to the first dispensing cartridge and the second dispensing cartridge and a motor operably coupled to the carousel.

14. The dispensing system of claim 13, wherein the controller activates the motor to rotate the carousel relative to the dispensing device, wherein a position of the first dispensing cartridge and a position of the second dispensing cartridge are adjusted relative to the dispensing device with rotation of the carousel.

15. The dispensing system of claim 12, wherein the engagement assembly includes a rail and a motor, wherein the dispensing device is operably coupled to the rail.

16. The dispensing system of claim 15, wherein the controller translates the dispensing device along the rail to adjust a position of the dispensing device relative to the first dispensing cartridge and the second dispensing cartridge.

17. The dispensing system of claim 12, wherein the identification device reads the identification features and communicates the information from the identification features to the controller.

18. The dispensing system of claim 12, wherein the dispensing device is at least one of a pump and a dispensing actuator configured to engage the pump.

* * * * *